US012761000B1

(12) United States Patent
Beck

(10) Patent No.: US 12,761,000 B1
(45) Date of Patent: Oct. 13, 2026

(54) SHIELD EDGE PROTECTION SYSTEM

(71) Applicant: TYR Tactical, LLC, Peoria, AZ (US)

(72) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 0 days.

(21) Appl. No.: 18/676,322

(22) Filed: May 28, 2024

Related U.S. Application Data

(63) Continuation of application No. 17/154,884, filed on Jan. 21, 2021, now Pat. No. 11,994,368, which is a continuation-in-part of application No. 17/148,015, filed on Jan. 13, 2021, now Pat. No. 11,650,025, and a continuation-in-part of application No. 16/893,245, filed on Jun. 4, 2020, now Pat. No. 11,448,485, which is a continuation of application No. 16/392,380, filed on Apr. 23, 2019, now Pat. No. 10,677,568, said application No. 17/154,884 is a continuation-in-part of application No. 16/018,052, filed on Jun. 26, 2018, now Pat. No. 12,516,913, said application No. 16/392,380 is a continuation of application No. 15/896,840, filed on Feb. 14, 2018, now Pat. No. 10,267,601, said application No. 17/148,015 is a continuation of application No. 15/710,365, filed on Sep. 20, 2017, now Pat. No. 10,921,094, which is a continuation-in-part of application No. 15/374,498, filed on Dec. 9, 2016, now Pat. No. 9,851,181, which is a continuation of application No. 15/257,745, filed on Sep. 6, 2016, now abandoned, which is a continuation-in-part of application No. PCT/US2016/040989, filed on Jul. 5, 2016, and a (Continued)

(51) Int. Cl.

| | |
|---|---|
| ***F41H 1/02*** | (2006.01) |
| ***A41D 1/04*** | (2006.01) |
| ***F41H 5/013*** | (2006.01) |
| ***F41H 5/04*** | (2006.01) |

(52) U.S. Cl.
CPC ..... *F41H 1/02* (2013.01); *A41D 1/04* (2013.01); *F41H 5/013* (2013.01); *F41H 5/0478* (2013.01); *F41H 5/0485* (2013.01)

(58) Field of Classification Search
CPC ..... F41H 1/02; F41H 5/013; F41H 5/0478; F41H 5/0485
See application file for complete search history.

(56) References Cited

U.S. PATENT DOCUMENTS

| | | | | |
|---|---|---|---|---|
| 11,451,256 | B1 * | 9/2022 | Beaulieu | H04M 1/185 |
| 2003/0121740 | A1 * | 7/2003 | Cheng | A45C 13/36 190/30 |

(Continued)

FOREIGN PATENT DOCUMENTS

| | | | | |
|---|---|---|---|---|
| WO | WO-2022124894 | A1 * | 6/2022 | F41H 5/08 |

*Primary Examiner* — Samir Abdosh
(74) *Attorney, Agent, or Firm* — Mark Williams, P.C.

(57) ABSTRACT

Implementations described and claimed herein provide a shield system that includes a shield, an edge protection system, and an edge coupling. The edge protection system may comprise a plurality of corner protectors disposed on a length of an edge protector. The edge protection system may be installable along a peripheral edge of the shield such that the edge protection system surrounds the outer perimeter of the shield. The edge coupling may be configured to engage the edge protection system and retain the edge protection system on the shield.

5 Claims, 34 Drawing Sheets

Related U.S. Application Data continuation-in-part of application No. 14/497,508, filed on Sep. 26, 2014, now Pat. No. 10,591,256, and a continuation-in-part of application No. 14/497,486, filed on Sep. 26, 2014, now Pat. No. 9,435,614, and a continuation-in-part of application No. 13/161,322, filed on Jun. 15, 2011, now abandoned.

(60) Provisional application No. 62/397,020, filed on Sep. 20, 2016, provisional application No. 62/289,089, filed on Jan. 29, 2016, provisional application No. 62/188,595, filed on Jul. 3, 2015, provisional application No. 61/883,140, filed on Sep. 26, 2013, provisional application No. 61/883,121, filed on Sep. 26, 2013, provisional application No. 61/384,560, filed on Sep. 20, 2010.

(56) References Cited

U.S. PATENT DOCUMENTS

| | | | | |
|---|---|---|---|---|
| 2013/0175231 | A1* | 7/2013 | Klinga | H02S 20/00 211/41.1 |
| 2015/0323292 | A1* | 11/2015 | Strauss | B32B 5/12 89/36.02 |
| 2016/0176174 | A1* | 6/2016 | Strauss | B32B 37/1018 156/286 |
| 2016/0176175 | A1* | 6/2016 | Strauss | B32B 37/10 156/286 |
| 2016/0298938 | A1* | 10/2016 | Trott | E06B 9/00 |
| 2020/0143567 | A1* | 5/2020 | Dukerschein | A45C 11/002 |

* cited by examiner

404

SHIELD EDGE PROTECTION SYSTEM

CROSS-REFERENCE TO RELATED APPLICATIONS

The present application is a continuation of U.S. patent application Ser. No. 17/154,884 entitled "Shield Edge Protection System" and filed on Jan. 21, 2021, which is a continuation in part of U.S. patent application Ser. No. 17/148,015 entitled "Personal Tactical System with Integrated Ballistic Frame" and filed on Jan. 13, 2021, which is a continuation of U.S. patent application Ser. No. 15/710,365 entitled "Personal Tactical System with Integrated Ballistic Frame" and filed on Sep. 20, 2017 which is a continuation-in part of U.S. patent application Ser. No. 15/374,498, entitled "Personal Tactical System" and filed on Dec. 9, 2016 (the "'498 Application") and further claims priority under 25 U.S.C § 119 to U.S. Provisional Patent Application No. 62/397,020, entitled "Integrated Ballistic Frame" and filed on Sep. 20, 2016. The '498 Application is a continuation of U.S. patent application Ser. No. 15/257,745, entitled "Personal Tactical System" and filed on Sep. 6, 2016 (the "'745 Application"). The '745 Application is a continuation-in-part of Patent Cooperation Treaty Application No. PCT/US2016/040989, entitled "Female Protective Vest" and filed on Jul. 5, 2016, which claims priority under 35 U.S.C. § 119 to U.S. Provisional Application No. 62/188,595, entitled "Female Protective Vest" and filed on Jul. 3, 2015. The '745 Application is further a continuation-in-part of U.S. patent application Ser. No. 14/497,508, entitled "Ballistic Vest System with Ballistic Ridge Component" and filed on Sep. 26, 2014, which claims priority under 35 U.S.C. § 119 to U.S. Provisional Application No. 61/883,140, entitled "Ballistic Vest System with Ballistic Ridge Component" and filed on Sep. 26, 2013. The '745 Application is further a continuation-in-part of U.S. patent application Ser. No. 14/497,486, now U.S. Pat. No. 9,435,614, entitled "Ballistic Vest System with Ballistic Vein Component" filed on Sep. 26, 2014, and issued on Sep. 6, 2016, which claims priority under 35 U.S.C. § 119 to U.S. Provisional Application No. 61/883,121, entitled "Ballistic Vest System with Ballistic Vein Component" and filed on Sep. 26, 2013. The '745 Application is further a continuation-in-part of U.S. patent application Ser. No. 13/161,322, entitled "High Performance Composite Fabric" and filed on Jun. 15, 2011, which claims priority under 35 U.S.C. § 119 to U.S. Provisional Application No. 61/384,560, entitled "Textile Articles Incorporating High Performance Composite Fabric" and filed on Sep. 20, 2010 and to U.S. Provisional Application No. 61/355,089, entitled "Kevlar Backed Nylon Tactical Material" and filed on Jun. 15, 2010. The '745 Application further claims priority under 35 U.S.C. § 119 to U.S. Provisional Application No. 62/289,089, entitled "Flexible Body Armor" and filed on Jan. 29, 2016. Each of the above-referenced applications is incorporated by reference herein in its entirety for any purpose.

The present application is a continuation of U.S. patent application Ser. No. 17/154,884 entitled "Shield Edge Protection System" and filed on Jan. 21, 2021, which is a continuation in part of U.S. patent application Ser. No. 16/893,245, filed on Jun. 4, 2020, entitled BALLISTIC DOLLY SYSTEM which is a continuation of Ser. No. 16/392,380, filed on Apr. 23, 2019, entitled BALLISTIC DOLLY SYSTEM and issued as U.S. Pat. No. 10,677,568, which is a continuation Ser. No. 15/896,840, filed on Feb. 14, 2018, entitled BALLISTIC DOLLY SYSTEM and issued as U.S. Pat. No. 10,267,601 and each of which is herein incorporated by reference in its entirety for any purpose.

The present application is a continuation of U.S. patent application Ser. No. 17/154,884 entitled "Shield Edge Protection System" and filed on Jan. 21, 2021, which is a continuation in part of U.S. patent application Ser. No. 16/018,052 entitled "Shield System" and filed on Jun. 26, 2018, which is herein incorporated by reference in its entirety for any purpose.

TECHNICAL FIELD

Aspects of the present disclosure relate to protective shield systems and more particularly to shield systems that improve the ballistic performance, durability and longevity of the shield in the field.

BACKGROUND

Ballistics shields are generally deployed in inhospitable environments and are designed to protect a user from ballistic events. There is a need to improve the ballistic performance, durability and/or longevity of the shield in the field.

SUMMARY

Implementations described and claimed herein provide a shield system that includes a shield, an edge protection system, and an edge coupling. The edge protection system may comprise a plurality of corner protectors disposed on a length of an edge protector. The edge protection system may be installable along a peripheral edge of the shield such that the edge protection system surrounds the outer perimeter of the shield. The edge coupling may be configured to engage the edge protection system and retain the edge protection system on the shield. Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTIONS OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

Figure 26:
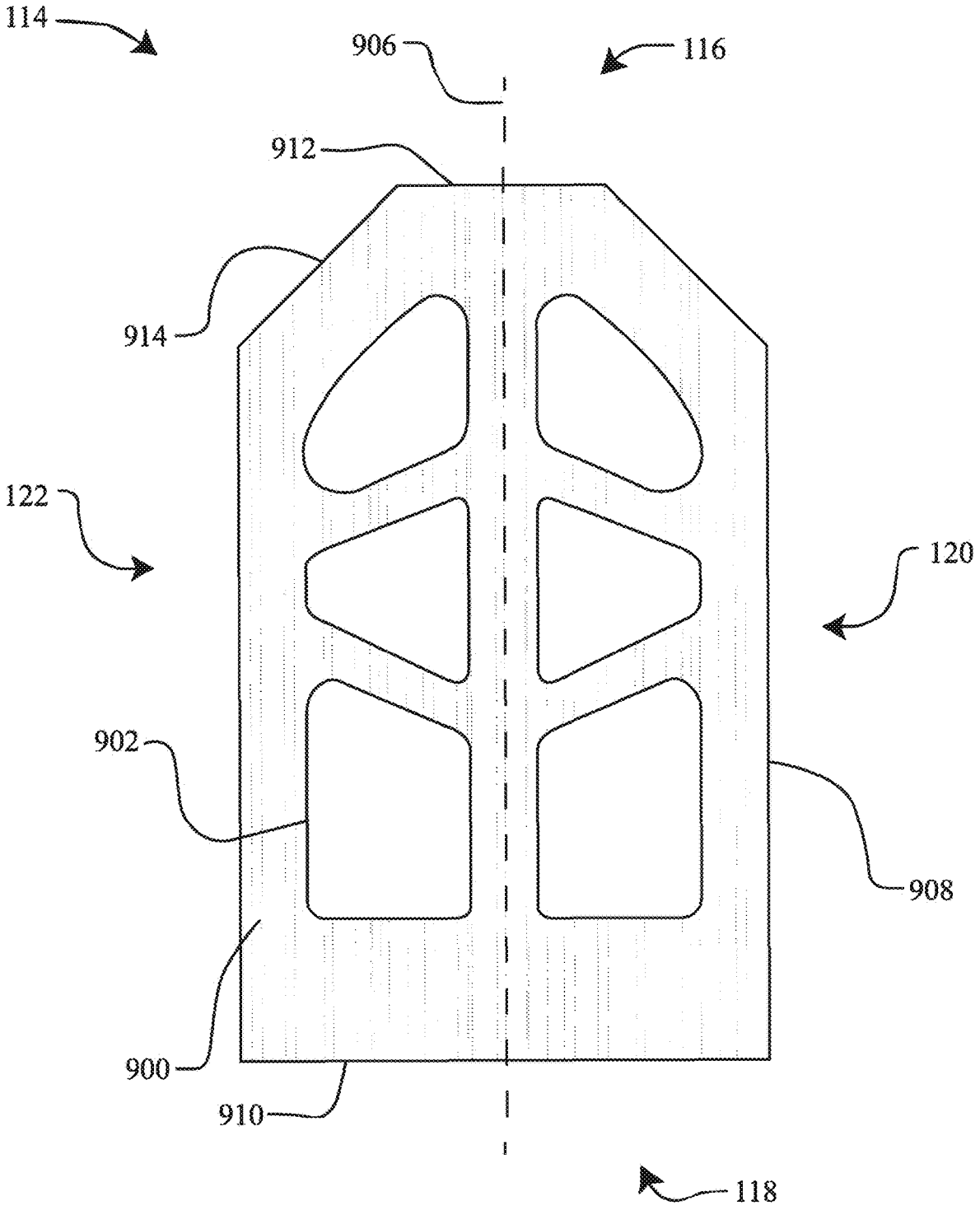
Figure 27:
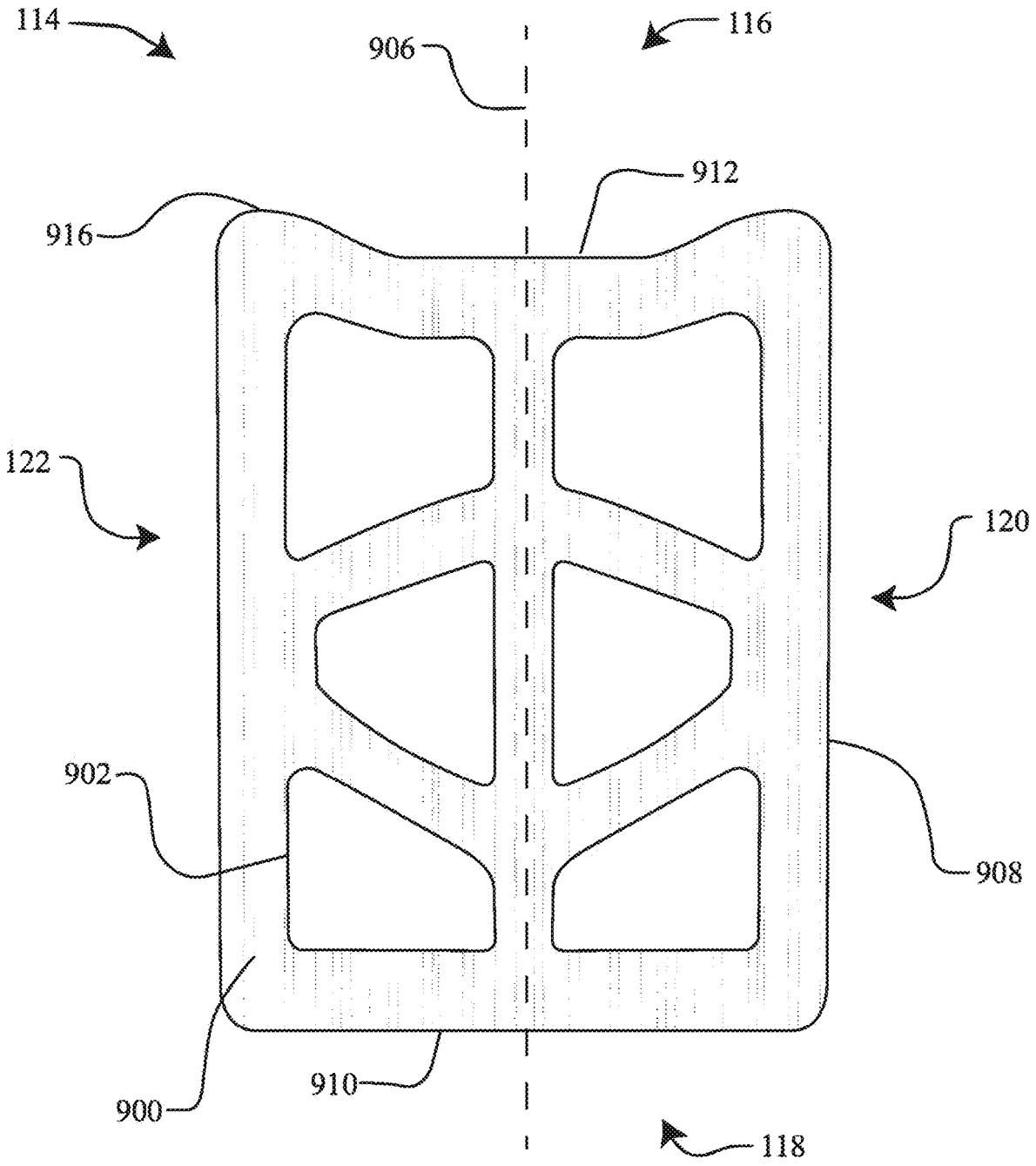

FIGS. 26 and 27 each show another example frame.

Figure 28:
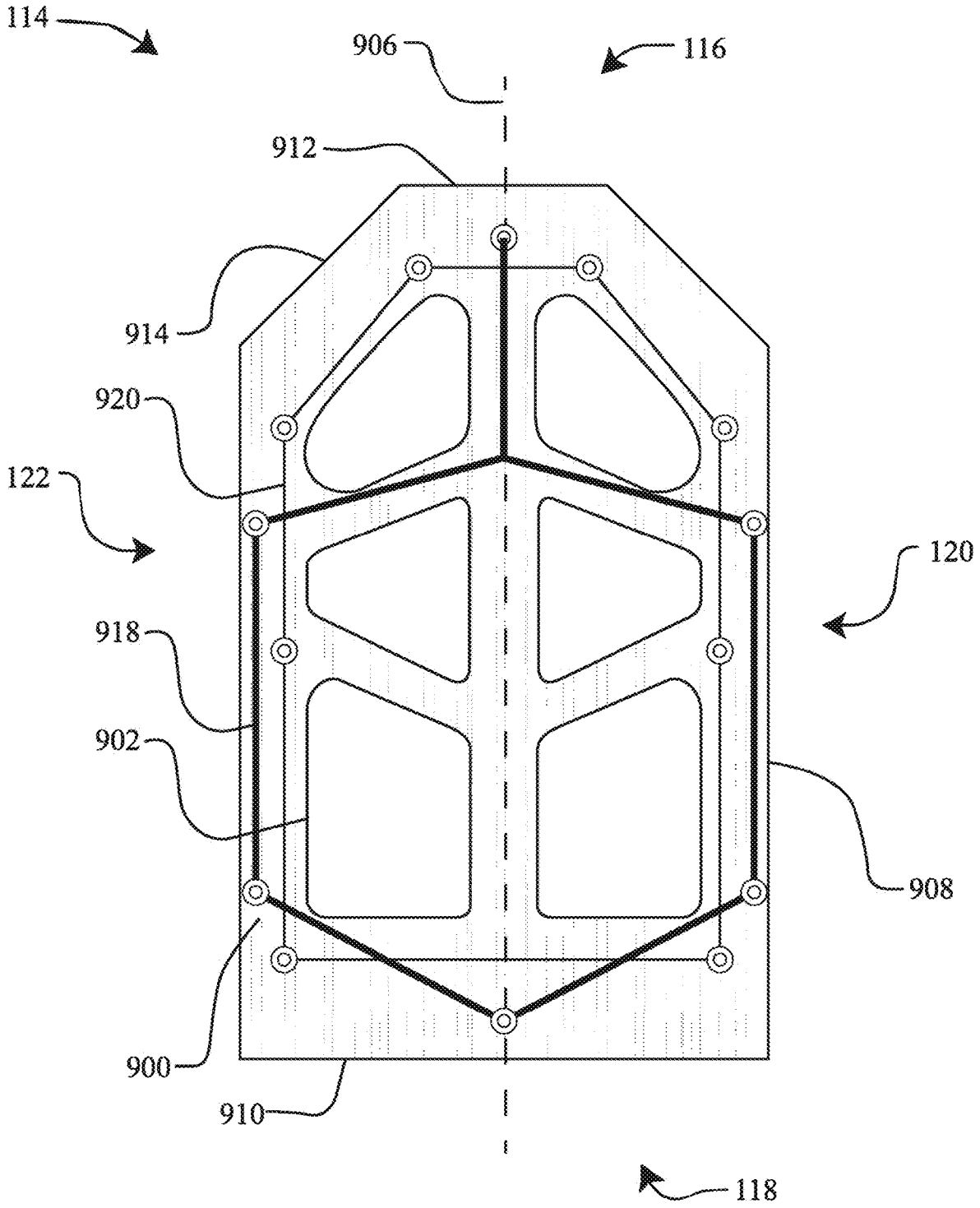

FIG. 28 illustrates the frame of FIG. 26 including an electrical system.

Figure 29:
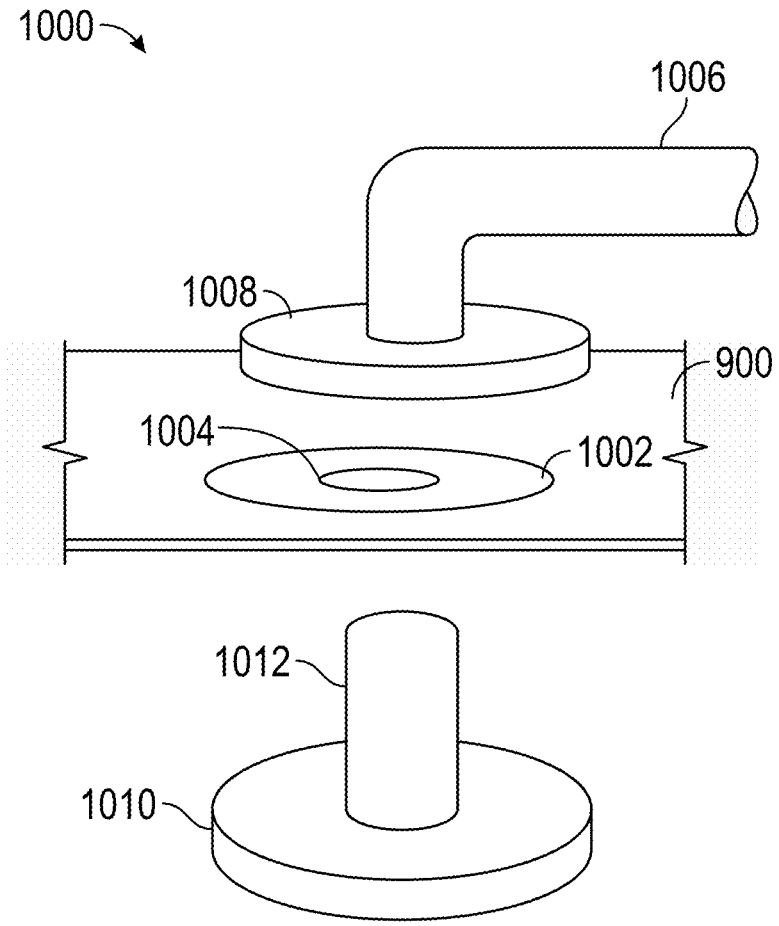

FIG. 29 shows an example connection adapter for connecting a cable to the frame of FIG. 28.

Figure 30:
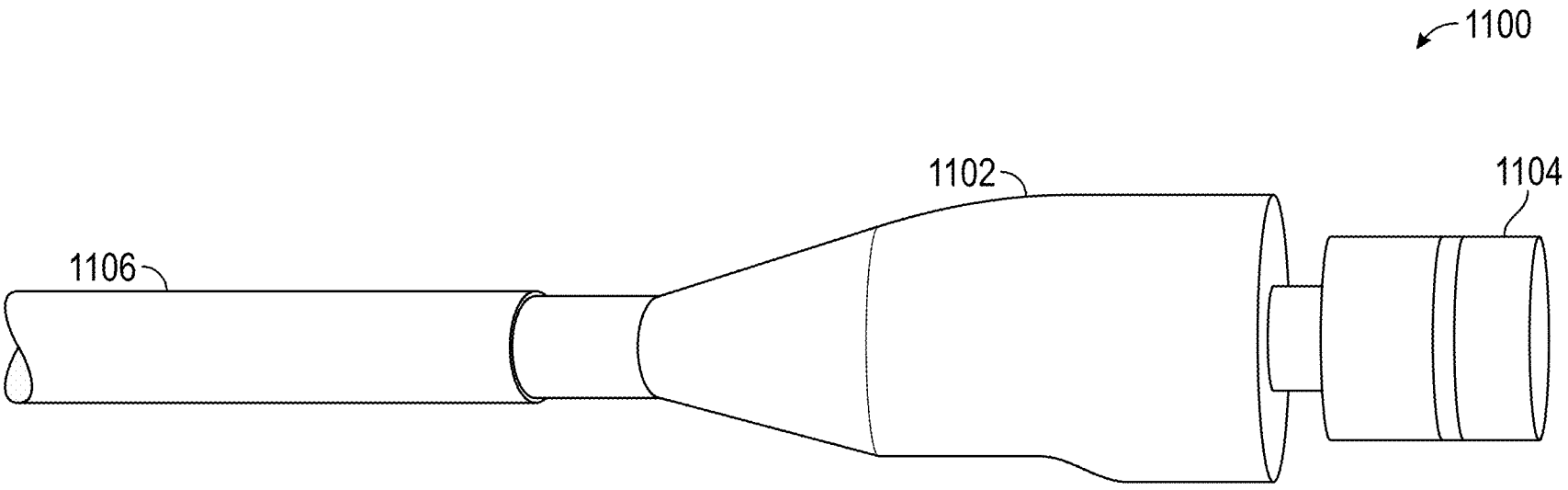
Figure 31:
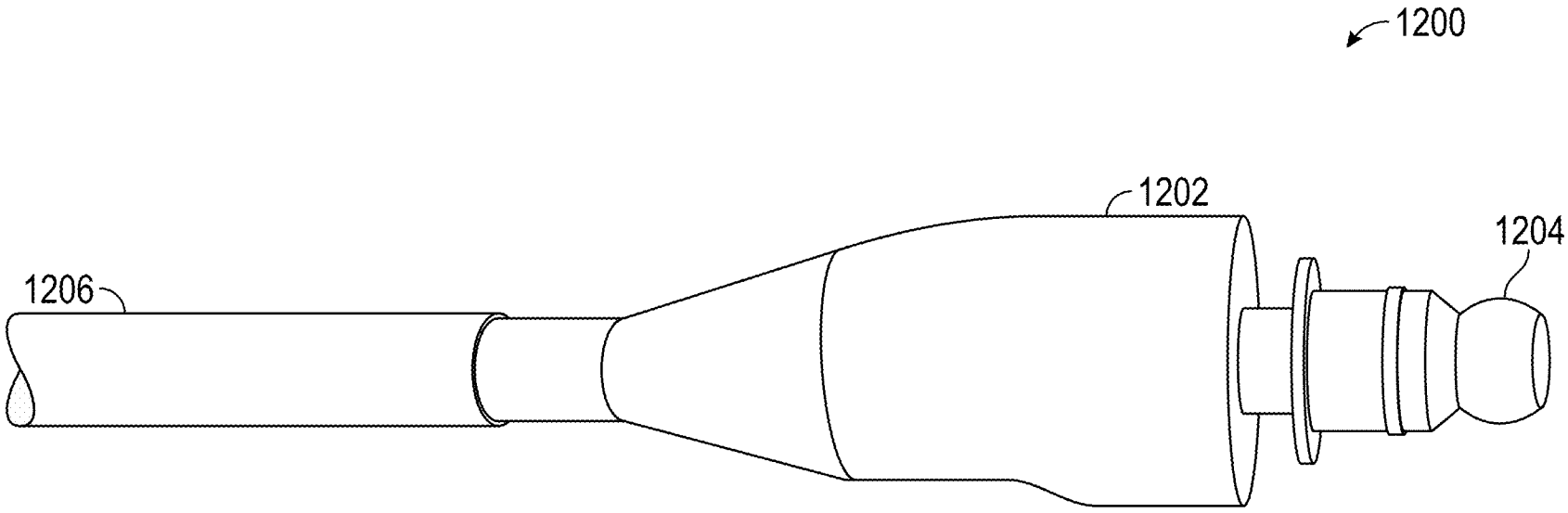

FIG. 30 illustrates an example communications adapter port. FIG. 31 depicts an example power adapter port.

DETAILED DESCRIPTION

The detailed description of exemplary embodiments herein refers to the accompanying drawings, which show exemplary embodiments by way of illustration. While these exemplary embodiments are described in sufficient detail to enable those skilled in the art to practice the inventions, other embodiments may be realized, and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Aspects of the present disclosure involve personal tactical systems configured to be worn or otherwise used by an individual for protection against threats, including ballistic projectiles and shrapnel from explosions. In one aspect, internal components, including a ballistic plate, a ballistic plate cover, flexible body armor, and/or a frame, are disposed in an interior of the tactical system. The interior is formed between an outer layer and an inner layer.

The presently disclosed technology relates generally to personal tactical systems. The various example implementations are described herein in the context of a tactical vest. It will be appreciated, however, that the presently disclosed technology is applicable in the context of other tactical systems, including, but not limited to, other tactical vests, carriers, belts, cummerbunds, tactical accessories (e.g., shoulder protection, pouches, abdomen protection, groin protection, leg protection, bicep/deltoid upper arm protection, etc.) and the like.

To begin a detailed description of an example personal tactical system 100 in the form of a tactical vest, reference is made to FIG. 1-4. In one implementation, the tactical system 100 includes one or more internal components 102 insertable or otherwise disposed in an interior 104 of the tactical system 100. The internal components 102 of the tactical system 100 include a flexible body armor 110, a ballistic plate 112, a ballistic frame 114, and/or the like. The internal components 102 increase ballistic protection decrease side spall and back face deformation, and provide structure to the tactical system 100, among other advantages. The interior 104 may be, for example, a pocket or similar enclosure formed by an outer layer 106 and an inner layer 108 of the tactical system 100. In some implementations the tactical system 100 includes one or more intermediate layers between the outer layer 106 and the inner layer 108.

Figure 1:
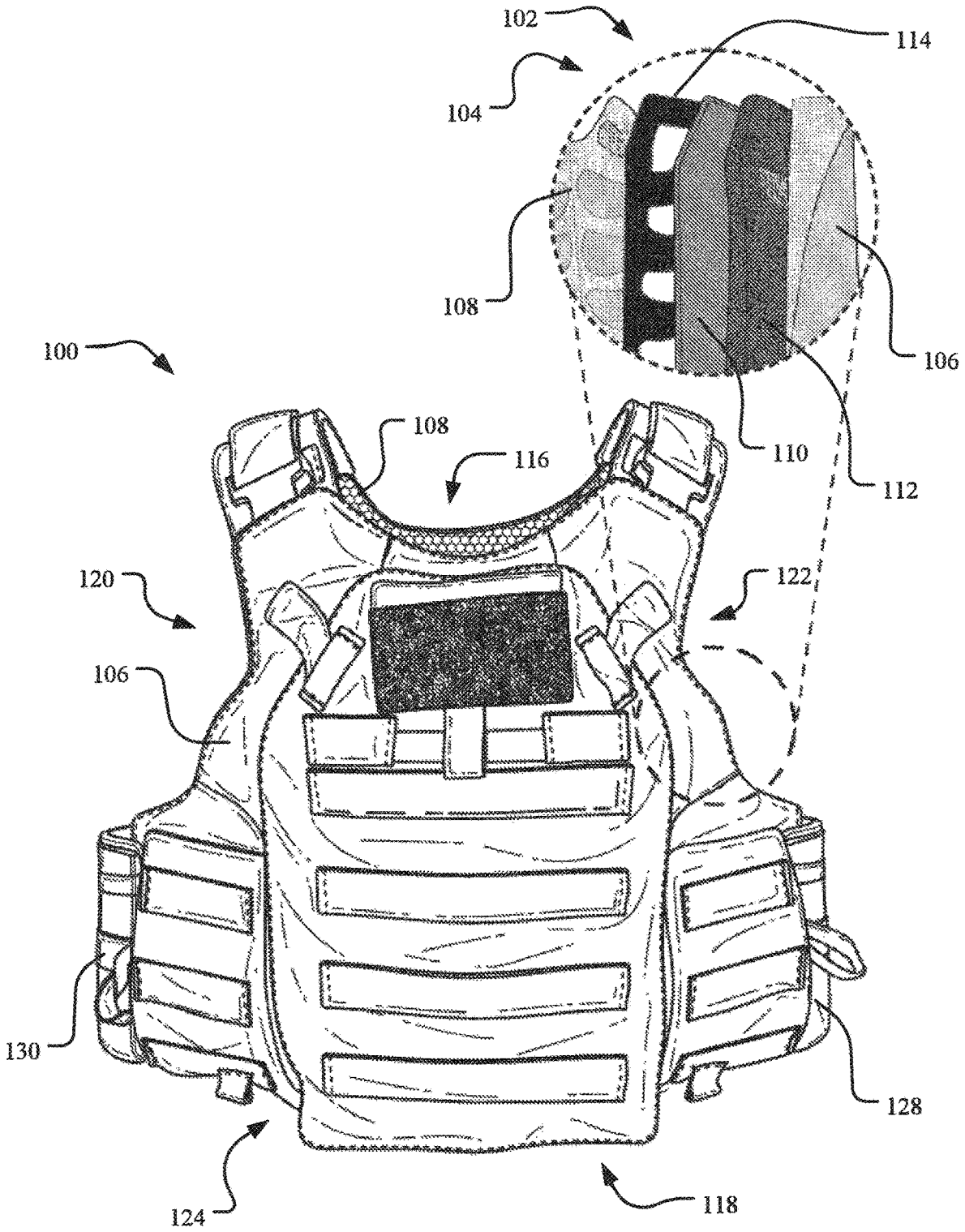
FIG. 1 is a front view of an example tactical system in the form of a tactical vest with internal components shown.
Figure 2:
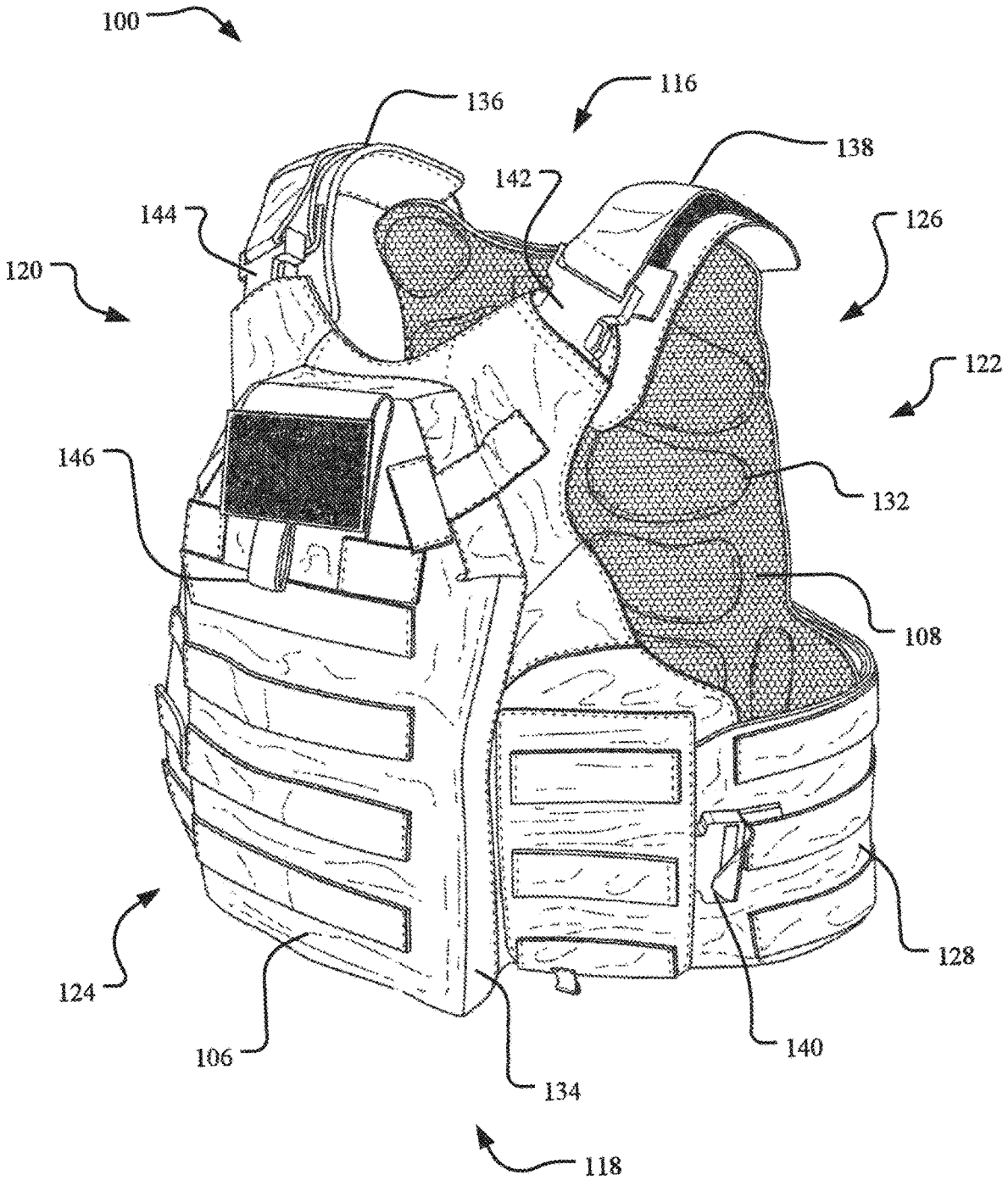
FIG. 2 is a perspective view of the tactical vest of FIG. 1.
Figure 3:
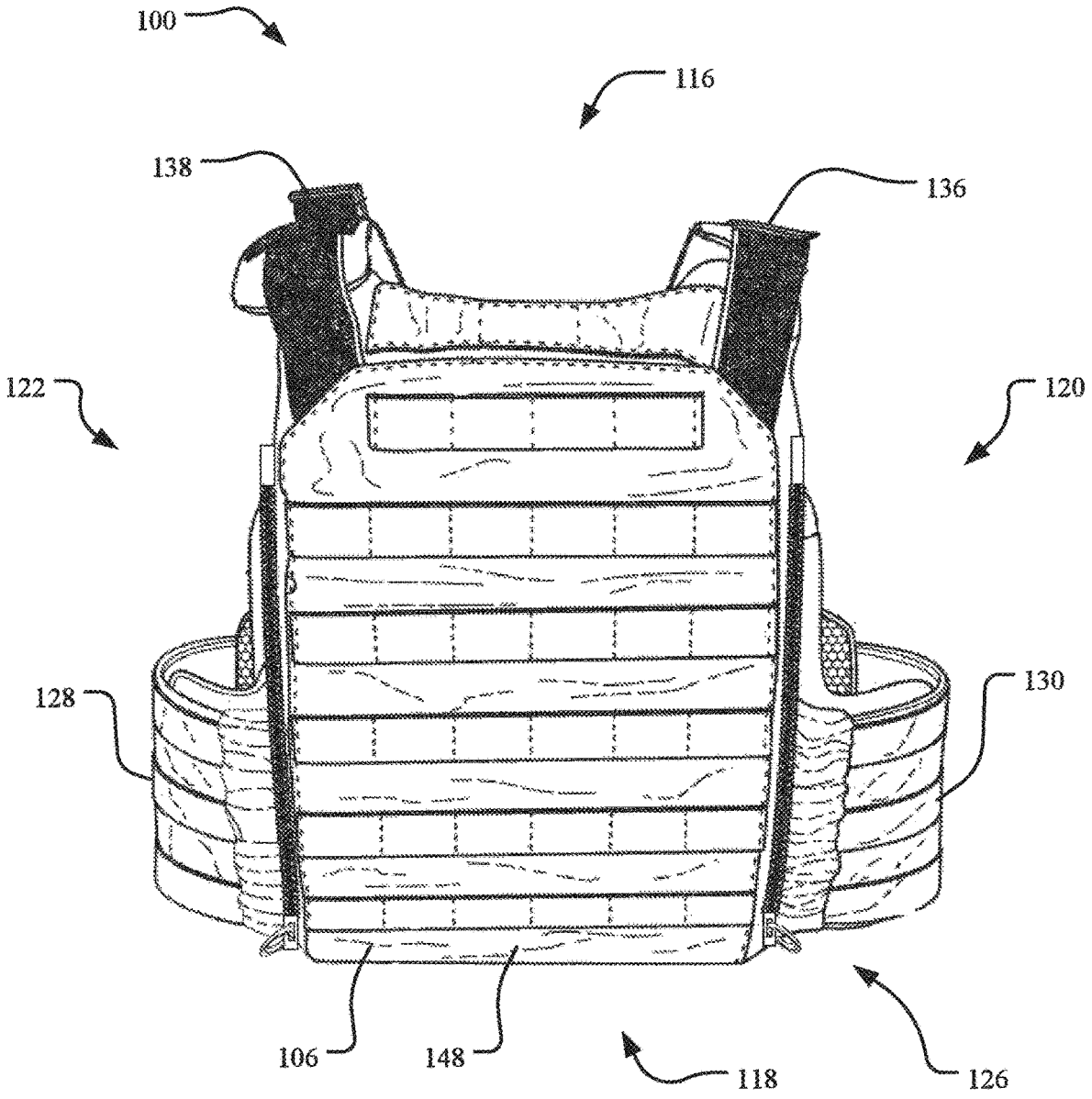
FIG. 3 shows a back view of the tactical vest of FIG. 1.
Figure 4:
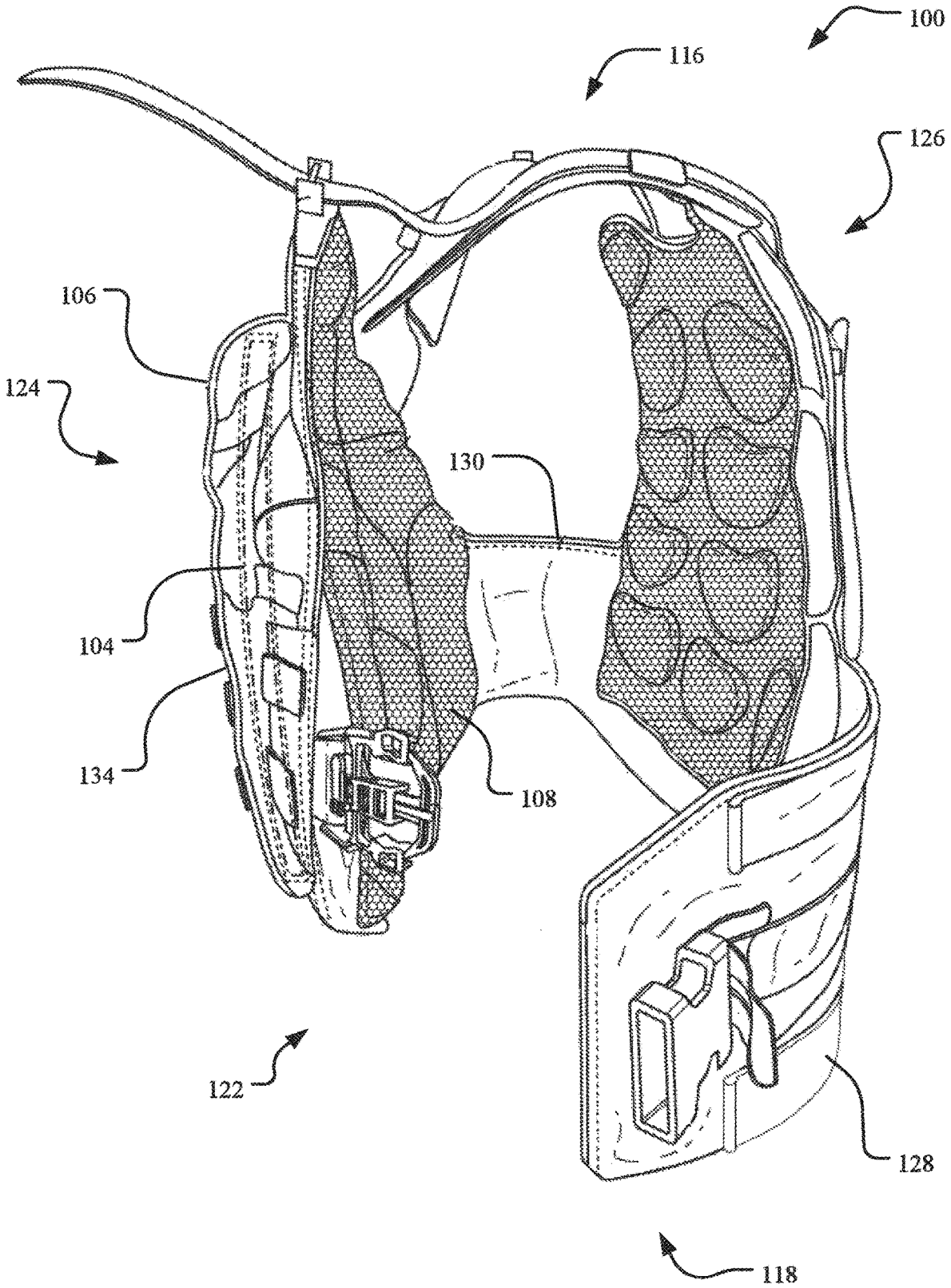
FIG. 4 shows a side perspective view of the tactical vest of FIG. 1 with a cummerbund belt buckle released.

As shown in FIG. 1, the outer layer 106 is exposed to an outside environment and is distal from the inner layer 108 to the wearer of the tactical system 100. Stated differently, the inner layer 108 faces the wearer and the outer layer 106 faces away from the wearer. In one implementation, the outer layer 106 is made from a lightweight hybrid material with superior abrasion, tear, and fire resistance characteristics, while providing load carriage support and improved durability, particularly in high-wear areas, such as corners, edges, seams, and exposed areas. The lightweight hybrid material of the outer layer 106 may be, for example, a laminate of 500-denier nylon and 200-400-denier para-aramid fibers in an ultra-tight weave. In one implementation, the inner surface 108 is made from a material that is antimicrobial and fire resistant treated.

In the context of a tactical vest, the tactical system 100 includes a front carrier 124 and a back carrier 126 each extending between a proximal end 116 and a distal end 118 and between a first side 120 and a second side 122. In one implementation, the sides 120-122 are shaped to accommodate the anatomy and movement of the wearer's arms, and the proximal end 116 is shaped to accommodate the anatomy and movement of the wearer's collar and neck area.

Further, the front carrier 124 may be shaped to accommodate the anatomy of a female wearer. As such, in one implementation, the front carrier 124 has a carrier female shape formed by an upper portion, a set of lateral portions, and a lower portion. The carrier female shape permits a full range of motion by and provides support to the female wearer, while maximizing comfort. The back carrier 126 similarly includes an upper back portion and a lower back portion adapted to maximize comfort without inhibiting motion of the female wearer.

In one implementation, the tactical system 100 includes a front carrier pocket 134 extending from or otherwise attached to the front carrier 124. The front carrier pocket 134 may define the interior 104 be adapted to receive and hold one or more of the internal components 102.

For example, the ballistic plate 112 may be disposed within the front carrier pocket 134 with a strike face oriented away from the wearer and a back face oriented towards the towards the inner layer 108. The ballistic plate 112 is a hard plate configured to provide ballistic protection against projectiles or shrapnel impacting a strike face of the ballistic plate 112.

A ballistic plate cover may wrap around at least a portion of a periphery of the ballistic plate 112 to provide additional protection against side spall created by augmentation of the ballistic plate 112. Such a ballistic plate cover further improves the structure of the front carrier pocket 134 and enhances area coverage and range of motion for increased ergonomics and performance, while providing additional ballistic coverage beyond a front edge of the ballistic plate 112 and beyond side edges of the ballistic plate 112. In one implementation, the ballistic plate cover provides approximately one inch of additional ballistic coverage beyond a front edge of the ballistic plate 112 and approximately 0.5 inches of additional ballistic coverage beyond side edges of the ballistic plate 112.

In addition, the tactical system 100 may include a ballistic flap that covers an opening to the front carrier pocket 134 and is configured to cover and protect the bottom portion of the ballistic plate 112 when disposed within the front carrier pocket 134. The ballistic flap may be made from a soft armor material similar to the flexible body armor 110 that, in combination with the ballistic plate cover assists in preventing side spall and backside deformation along the bottom portion of the ballistic plate 112. in one implementation, the tactical system 100 includes a soft armor liner that extends along the peripheral edge of the front carrier pocket 134 to provide further protection to the ballistic plate 112. The soft armor liner may be sewn along a peripheral edge of the front carrier pocket 134 such that the soft armor liner at least substantially covers a peripheral edge of the ballistic plate cover when the ballistic plate 112 is disposed within the front carrier pocket 134. In some implementations, the soft armor liner may be a strip of soft armor material (e.g., similar material to the outer layer 106), while in other implementations the soft armor liner may substantially or completely line the interior of the front carrier pocket 134.

The flexible body armor 110 may be disposed in the front carrier pocket 134 behind the ballistic plate 112 on the back face side to provide additional protection and force absorption. In one implementation, the flexible body armor 110 is made from a ballistic fiber comprising at least a portion of woven fabric stitched directly to unidirectional laminates. The woven fabric is generated from ultrahigh molecular weight polyethylene (UHMWPE) fiber, which when used in conjunction with the unidirectional laminates, is effective as anti-ballistic ply structures. A ballistic arrangement of the ballistic filler includes the UHMWPE woven fabric being backed by unidirectional laminates. More specifically, the ballistic arrangement constitutes one or more regions where one or more plies of UHMWPE woven fabric are backed by one or more plies of unidirectional laminates. As used in the present disclosure, respective to each region, "backed" refers to plies residing closer to a wearer, and "fronted" refers to plies closer to a strike face of the outer layer 106. In one implementation, one or more of the regions comprised of UHMWPE woven fabric backed by unidirectional laminate are stitched together uniformly using a quilt pattern or some other uniform stitching pattern.

A ballistic frame 114 may be disposed within the front carrier pocket 134 behind or in front of the flexible body armor 110. The ballistic frame 114 includes a body configured to improve overall load carriage performance of the front carrier pocket 134 and the tactical system 100 by providing a rigid platform to add weight. The frame body further reduces fatigue by improving the structure of the tactical system 100 by retaining the flexible body armor 110 in a configuration that prevents bunching and provides support to the ballistic plate 112 to improve edge hit protection. The ballistic frame 114 is loose from or otherwise unattached to the flexible body armor 110 within the front carrier pocket 134. The ballistic frame 114 absorbs and otherwise dissipates energy from an impact of a projectile against the ballistic plate 112 and/or the flexible body armor 110. The ballistic frame 114 body may be solid or have one or more openings therethrough. The inner layer 108 may include one or more pads 132 to enhance comfort and further dissipate forces generated from an impact. The pads 132 may be sized and shaped to mirror the openings in the ballistic frame 114.

In one implementation, the back carrier 126 includes a releasable back panel 148, which may be used to releasably connect to or otherwise secure one or more protective devices and/or to integrate with other tactical devices. The back carrier 148 may include a back carrier pocket within, adjacent to, or in place of the releasable back panel 148 to receive and hold one or more internal components 102. In one implementation, the releasable back panel 148 is releasably engaged to the back carrier 126 with a zipper assembly.

The front carrier 124 is connected to the back carrier 126 at the proximal end 116 and/or the distal end 118. In one implementation, the front carrier 124 is connected to the back carrier 126 at the distal end 118 with a cummerbund having a first cummerbund portion 128 and a second cummerbund portion 130. It will be appreciated, however, that a belt, straps, or other side connections may supplement or be used in place of the cummerbund. One or more of the cummerbund sections 128 and 130 may be connected to the front carrier 124 using a cummerbund buckle 140 disposed within a pocket.

In one implementation, the front carrier 124 is connected to the back carrier 126 at the proximal end 116 with shoulder portions, including a first shoulder strap 136 and a second shoulder strap 138. The shoulder straps 136 and 138 may each be adjustable. For example, the first shoulder strap 136 and the second shoulder strap 138 may each loop through a shoulder buckle forming an adjustment portion. The adjustment portions may be secured, for example, using paired hook and loop fasteners. In one implementation, the shoulder straps 136 and 138 each include a shoulder pad with a low to enhance comfort and provide additional load distribution.

In the context of a tactical vest, the tactical system 100 may include a cutaway system permitting single-handed release. In one implementation, the cutaway system includes a plurality of buckles, which when released permit the tactical vest to be easily and quickly removed. The plurality of buckles may include, for example, the shoulder buckles 142 and 144 and the cummerbund buckle(s) 140. In one implementation, the plurality of buckles are connected to a quick-release tab 146 via corresponding wires. When the quick-release tab 146 is pulled, each of the plurality of buckles is automatically disengaged, facilitating the removal of the tactical vest. The cutaway system may be reengaged, and the tactical vest reassembled by reengaging the plurality of buckles. In one implementation, the wires are housed within the interior 104 and in communication with the buckles using one or more pockets or openings.

In one implementation, each of the plurality of buckles are connected to the cutaway system via one or more wires to release the buckles upon pulling of the quick-release tab 146. For example, the cummerbund buckle 140 may include a female buckle portion and a male buckle portion. The female buckle portion includes an opening adapted to receive a body of the male buckle portion and slots to releasably engage buckle arms of the male buckle portion. In one implementation, a releasing member is connected to a wire of the cutaway system and configured to displace the buckle arms. When the quick-release tab 146 is pulled, the wires of the cutaway system are displaced, which displaces the releasing member and in turn the buckle arms, thereby disengaging the male buckle portion from the female buckle portion. The shoulder buckles 142 and 144 may include similar features and functionality.

Figure 5:
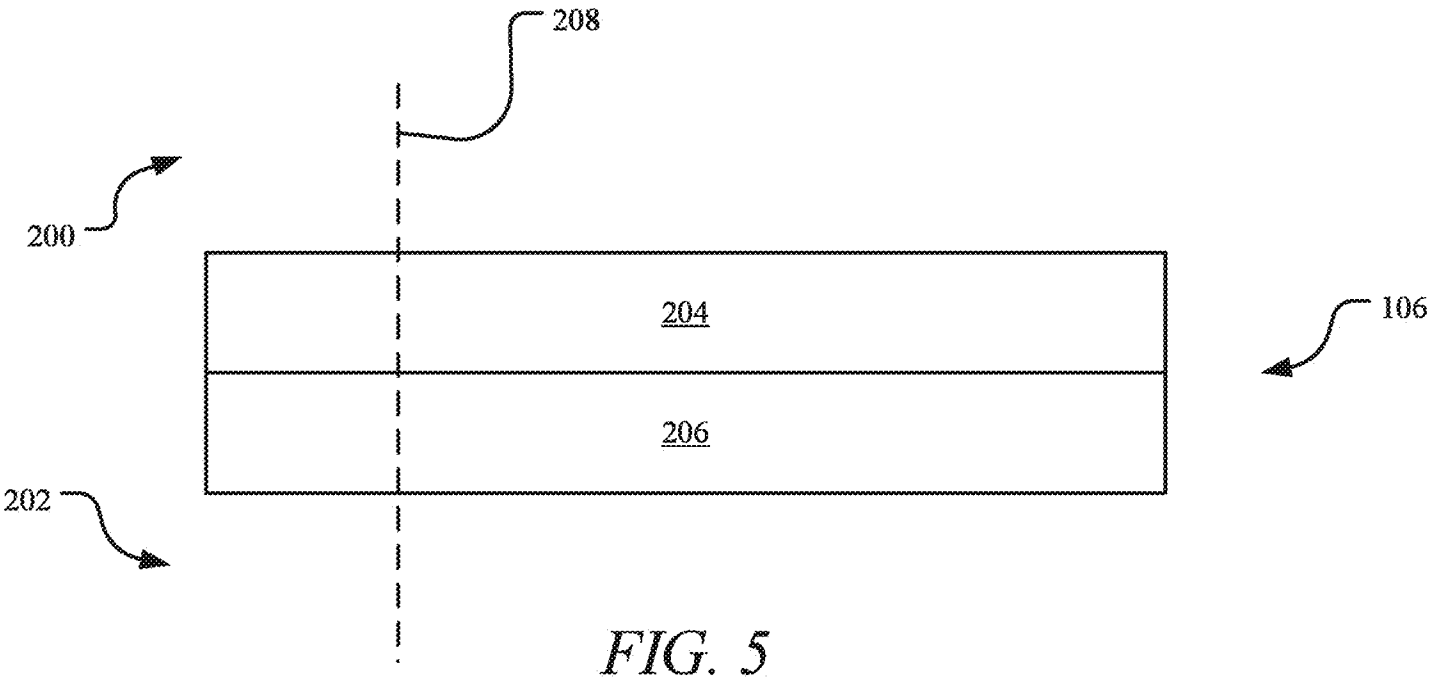
FIG. 5 illustrates an example outer layer of the tactical system.

For a detailed description of the outer layer 106, reference is made to FIG. 5. In one implementation, the outer layer 106 is a composite of a first layer 204 facing an outside environment 200 and a second layer 206 facing in a direction 202 inwardly toward the interior

104. Stated differently, the first layer 206 is backed by the second layer 206. The first layer 204 and the second layer 206 form a lightweight hybrid material with superior abrasion, tear, and fire resistance characteristics that provides load carriage support and improved durability, particularly in load carriage points 208, such as corners, edges, seams, high wear areas, and exposed areas.

In one implementation, the first layer 204 is a synthetic fabric outer layer. For example, the first layer 204 may be a nylon fabric, such as a high-performance Nylon-6,6. The weight of the nylon fabric of the first layer 204 may be between approximately 200 and 1000 denier, and in one particular example implementation, the weight is about 500 denier.

The second layer 206 may be a backing layer made from a high strength, damage resistant material. More particularly, the second layer 206 may be made of high tenacity polymer fibers, including, but not limited to, aramid fibers, para-aramid fibers, para-aramid synthetic fibers, high performance polyethylene fibers, and/or other materials having a high tensile strength-to-weight ratio. Examples of materials from which the second layer 206 may include, without limitation: Kevlar®, Twaron, terephthaloyl chloride (TCI), and high molecular weight polyethylene (HMWPE). Other suitable materials include polybenzobisoxazole fibers (PBO), ballistic nylon, and/or heat resistant aramid fiber products such as Nomex® and Protera® fabrics. The fibers of the second layer 206 may have a tensile strength greater than about 2000 MPa (or greater than about 7 grams per denier) and an elastic modulus greater than about 60 GPa.

In one implementation, high performance polymer fibers for the second layer 206 are utilized in the form of a woven fabric, including for example woven fabrics generally used for repelling and trapping hand driven sharp objects such as knives, awls, shanks and the like. An exemplary woven fabric for the second layer 206 may be constructed from yarn of anywhere between about 100 and 1200 denier and aerial densities in the range of 3 to 10 ounces per square yard ("OSY"). For example, fabrics constructed of yarns in the 200 to 300 denier range, and aerial densities in the 3 to 4 OSY range may be used where the tactical system 100 is a ballistic accessory, such as a pouch, small duffel, backpacks, or the like. Alternatively, where the tactical system 100 is heavier, such as a large suitcase or equipment bag, larger yarns in the 700 to 1200 denier range and densities in the 7 to 10 OSY range may be used. In one particular example implementation where the tactical system 100 is a tactical vest, the first layer 204 is made from a 500-denier nylon and the second layer 206 is made from 200-400-denier para-aramid fibers.

The woven fabric of the second layer 206 may be formed of a relatively tight, puncture resistant weave, comprising, for example, at least 40 fibers per inch in a first (warp) direction and at least 40 fibers per inch in a second (fill) direction. In one implementation, the second layer 206 comprises a weave with between 60 and 72 fibers per inch in both the warp and fill directions. In addition, the fabric of the second layer 206 may be formed by tightly weaving multi-filament yarns to obtain a warp yarn "density" or "cover" in excess of 100 percent at the center of the fill yarn and a fill yarn density or cover in excess of 75 percent as measured between two warp ends. Such ultra-tight weaves may comprise in excess of 100 fibers per inch in the warp and fill directions and filament crossovers in the range of about 50,000,000 (fifty million) filament crossovers per square inch up to 90,000,000 (ninety million) filament crossovers per square inch.

In one example, the second layer 206 is Dupont™ Kevlar® Correctional™, which is an extremely tight weave utilizing filaments one fourth the size of comparable materials. Another suitable commercially available material is a woven puncture resistant product sold under the trademark TURTLESKIN by Warwick Mills, Inc., of New Ipswich, N.H. The weight of the second layer 206 may range between approximately 200 and 300 denier where the tactical system 100 includes lightweight personal gear such as packs and pouches and between approximately 500 and 1000 denier where the tactical system 100 includes larger, heavier articles, such as large suitcases and equipment duffels.

In one implementation, the first layer 204 and the second layer 206 are consolidated into a unitary composite fabric using any suitable technique such as lamination, bonding, stitching, and/or the like. Suitable bonding methods include, for example, the use of various types of adhesives, such as air-drying adhesives, chemically setting adhesives, radiation activated adhesives such as ultraviolet (UV) activated dental adhesives, hot-melt adhesives, and pressure sensitive adhesives. An adhesive may be pre-applied on at least one of the first layer 204 or the second layer 206 or separately introduced during a lamination process. In one implementation, the first layer 204 and the second layer 206 are laminated under heat and pressure using a solid, polymer based thermoplastic adhesive, such as a polyamide, polyester, elastomeric urethane, or polyolefin polymer. For example, the first layer 204 may be laminated to the second layer 206 using a dry, non-woven mat, or web of a polymer-based thermoplastic or other thermoplastic adhesives. The first layer 204 and the second layer 206 and the thermoplastic adhesive may be supplied from respective adjacent spools and fed through a laminating machine with the thermoplastic web sandwiched between the first layer 204 and the second layer 206.

As noted above, the first layer 204 and the second layer 206 may also be consolidated using various types of Pressure Sensitive Adhesives, also referred to as "PSA"s. PSAs are distinguished from most other types of adhesives in that they bond on contact, rather than through a solidifying process such as evaporation, chemical reaction, or melting. PSAs are usually based on an elastomer compounded with a suitable tackifier (e.g., a rosin ester). The elastomers may include those based on natural rubber, Nitriles, Butyl rubber, Acrylics, Styrene block copolymers, vinyl ethers, Ethylene-vinyl acetate, and various silicon rubbers. In one implementation, the PSA comprises an acrylic adhesive such as a permanent assembly tape or an acrylic sheet.

The strength of the second layer 206 makes the composite material of the outer layer 106 particularly beneficial in the load carriage points 208 of the tactical system 100. Examples of the load carriage points 208 include, without limitation, corners of ammunition pouches, fragmentation pouches, radio communication pouches, armor pockets in armor plate carriers, and/or load carriage points. In ballistic vests and ballistic armor carriers the outer layer 106 also increases longevity and strength of load carriage points 208, particularly once the outer layer 106 is sewn through. Seams can be further strengthened by folding the seam over to double or triple thickness prior to stitching. In addition, any tears or de-laminations in the first layer 204 of the outer layer 106 can be temporarily field repaired by re-attaching the damaged first layer 204 to the intact second layer 206 using a fast setting adhesive such as Cyanoacrylate liquid adhesive. Alternatively, if portions of the first layer 204 are missing or worn away making re-attachment impractical, the intact second layer 206 can instead simply be left exposed, and if desired, temporarily disguised using a suitably colored paint or ink marker.

Although the composite fabric of the outer layer 106 has been described primarily in terms of the first layer 204 and the second layer 206, the outer layer 106 may comprise additional or different layers. For example, the outer layer 106 may comprise a plurality of outer layers similar to the first layer 204, or a plurality of backing layers similar to the second layer 206, or multiple layers of each. In addition, the layers may be arranged in various configurations, such as two backing layers of the second layer 206 on one side of a single outer layer of the first layer 204, or a sandwich configuration with an outer layer of the first layer 204 on either side of one or more backing layers of the second layer 206. The composite fabric of the outer layer 106 may also be combined with various other material layers, such as a liner made of a breathable or insulative type of fabric or material. The additional materials may be consolidated or attached to the first layer 204 and/or the second layer 206 using any of the above-described methods and materials. Further, various other combinations of layers and materials are contemplated as foreseeable and intended to fall within the scope of the high performance composite fabric of the outer layer 106.

Figure 6:
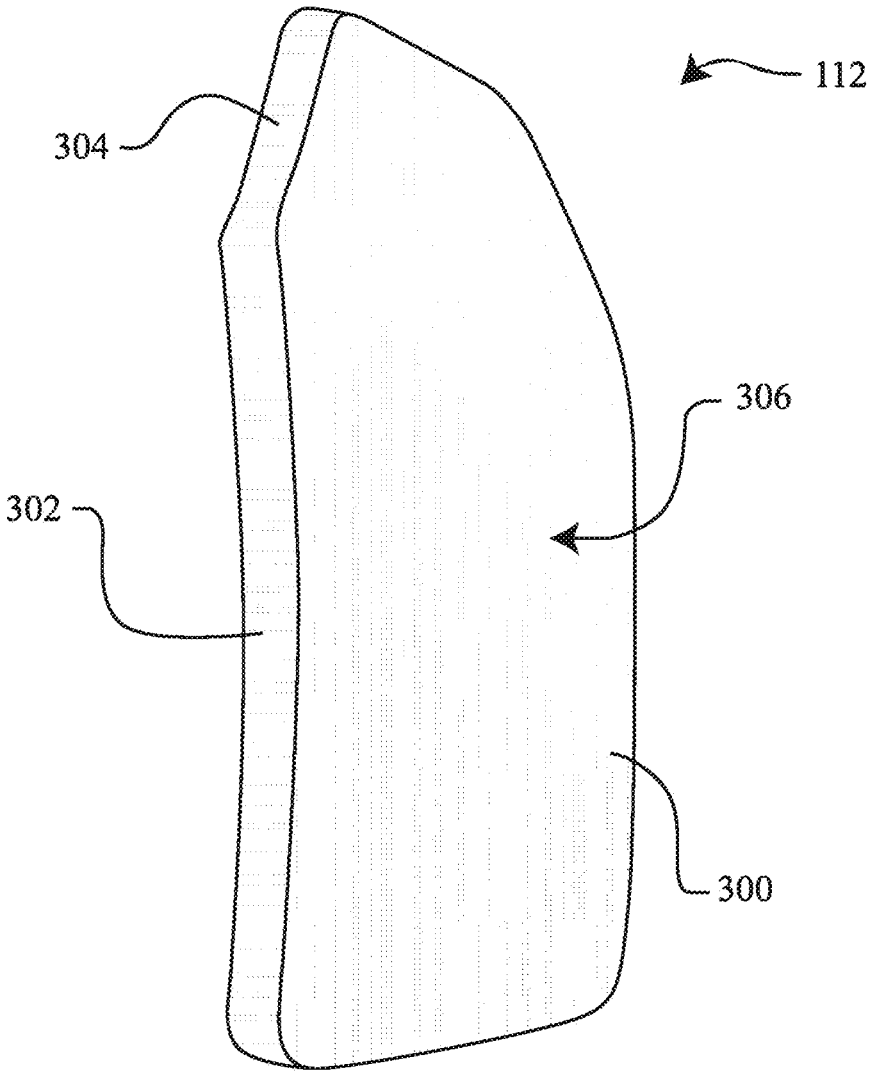
FIG. 6 depicts an example ballistic plate of the tactical system.
Figure 7:
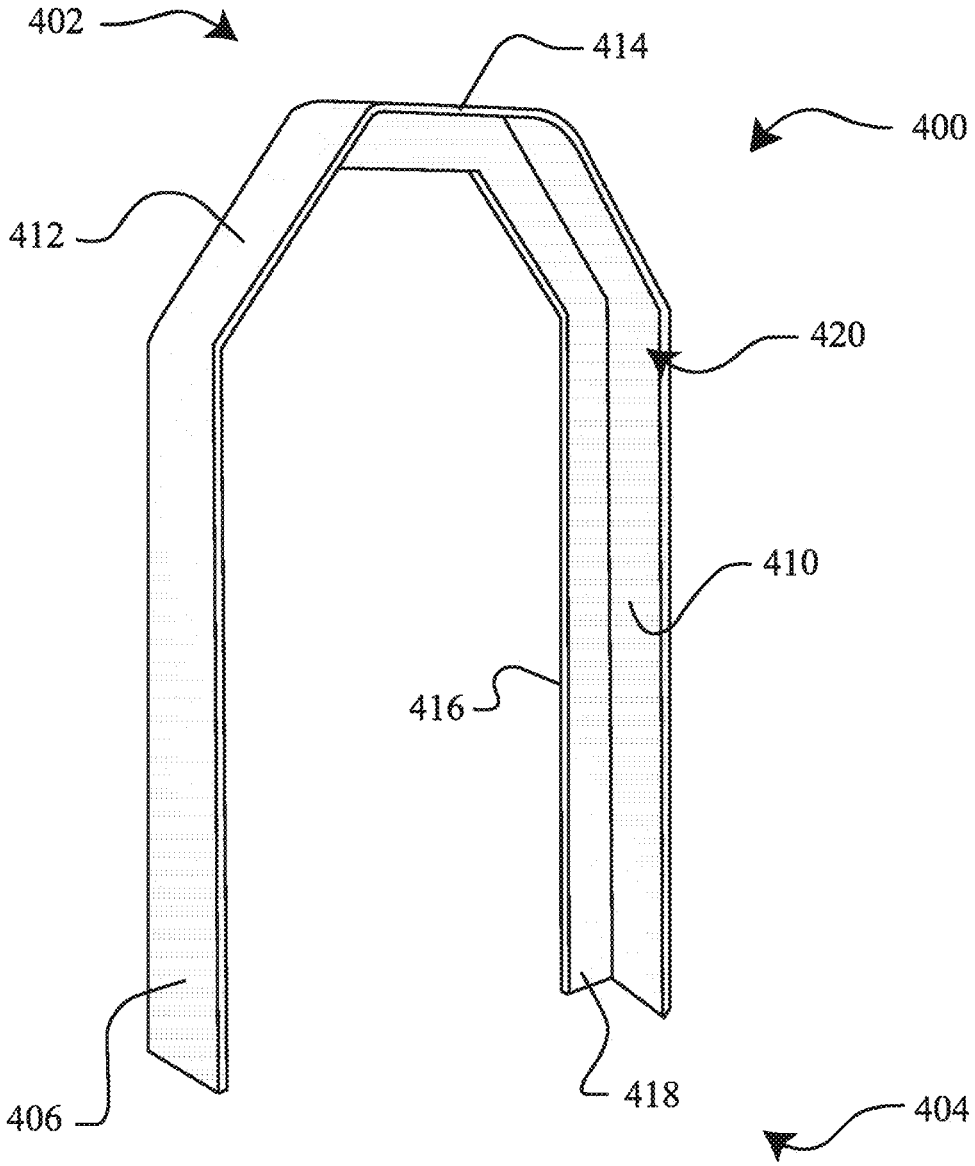
FIG. 7 shows a perspective view of an example ballistic plate cover of the tactical system.

Turning to FIG. 6, in one implementation, the ballistic plate 112 includes a body with a strike face 300 disposed opposite a back face 302. A peripheral edge 304 extends along a periphery of the body between the strike face 300 and the back face 302. A non-peripheral area 306 of the ballistic plate 112 extends from a center of each of the strike face 300 and the back face 302 towards a peripheral area disposed near the peripheral edge 304.

As can be understood from FIGS. 7-11B, in one implementation, a ballistic plate cover 400 may wrap around at least a portion of the peripheral area of the ballistic plate 112 to provide additional protection against back face deformation and/or side spall created by augmentation of the ballistic plate 112. Back face deformation occurs when a ballistic projectile impacts the strike face 300 and causes the back face 302 to deform or bulge outwardly. Side spall occurs when a ballistic projectile impacts the peripheral area of the ballistic plate 112 such that shrapnel from the ballistic projectile impact and/or debris of material from the impacted portion of the ballistic plate 112 potentially penetrates the flexible body armor 110 and/or injure the wearer.

The ballistic plate cover 400 further enhances area coverage and range of motion for increased ergonomics and performance, while providing additional ballistic coverage beyond the ballistic plate 112 in a direction outward from the strike face 300 and in a direction outward from the peripheral edge 304. In one implementation, the ballistic plate cover 400 provides approximately one inch of additional ballistic coverage beyond the strike face 300 and approximately 0.5 inches of additional ballistic coverage beyond the peripheral edge 304.

The ballistic plate cover 400 includes a body extending from a proximal end 402 to a distal end 404. The body of the ballistic plate cover 400 may be made from a polyethylene material or other types of thermoplastic materials. For example, the body of the ballistic plate cover 400 may be made from a stretchable and elastic spandex material reinforced with a unidirectional and/or aramid material.

In one implementation, the body of the ballistic plate cover 400 includes a peripheral portion including side portions 406 extending proximally to a top portion 414. The peripheral portion may have a variety of shapes mirroring a shape of the peripheral edge 304 of the ballistic plate 112. For example, the peripheral portion may extending linearly and taper inwardly in a proximal direction. More particularly, the peripheral portion 406 may include the side portions 406 extending parallel to each other and then tapering inwardly at tapered portions 412 until reaching the top portion 414. The peripheral portion includes an inner peripheral surface 410.

In one implementation, the body of the ballistic plate cover 400 includes a back portion 416 connected to the peripheral portion. For example, the back portion 416 may be connected at an edge of the peripheral portion, such that the back portion 416 is disposed inwardly from the side portions 406, the tapered portions 412, and/or the top portion 414. The back portion 416 includes an inner back surface 418. In one implementation, the inner back surface 418 is disposed at an angle relative to the inner peripheral surface 410. For example, the inner back surface 418 and the inner peripheral surface 410 may be disposed perpendicularly to each other. The inner back surface 418 and the inner peripheral surface 410 collectively form a receiving portion 420, such as an open-ended slot or a channel, configured to receive the body of the ballistic plate 112. In one implementation, the receiving portion 420 releasably engages the ballistic plate 112. In another implementation, the receiving portion 420 is secured to the ballistic plate 112 with an adhesive or similar engaging mechanism.

Figure 8:
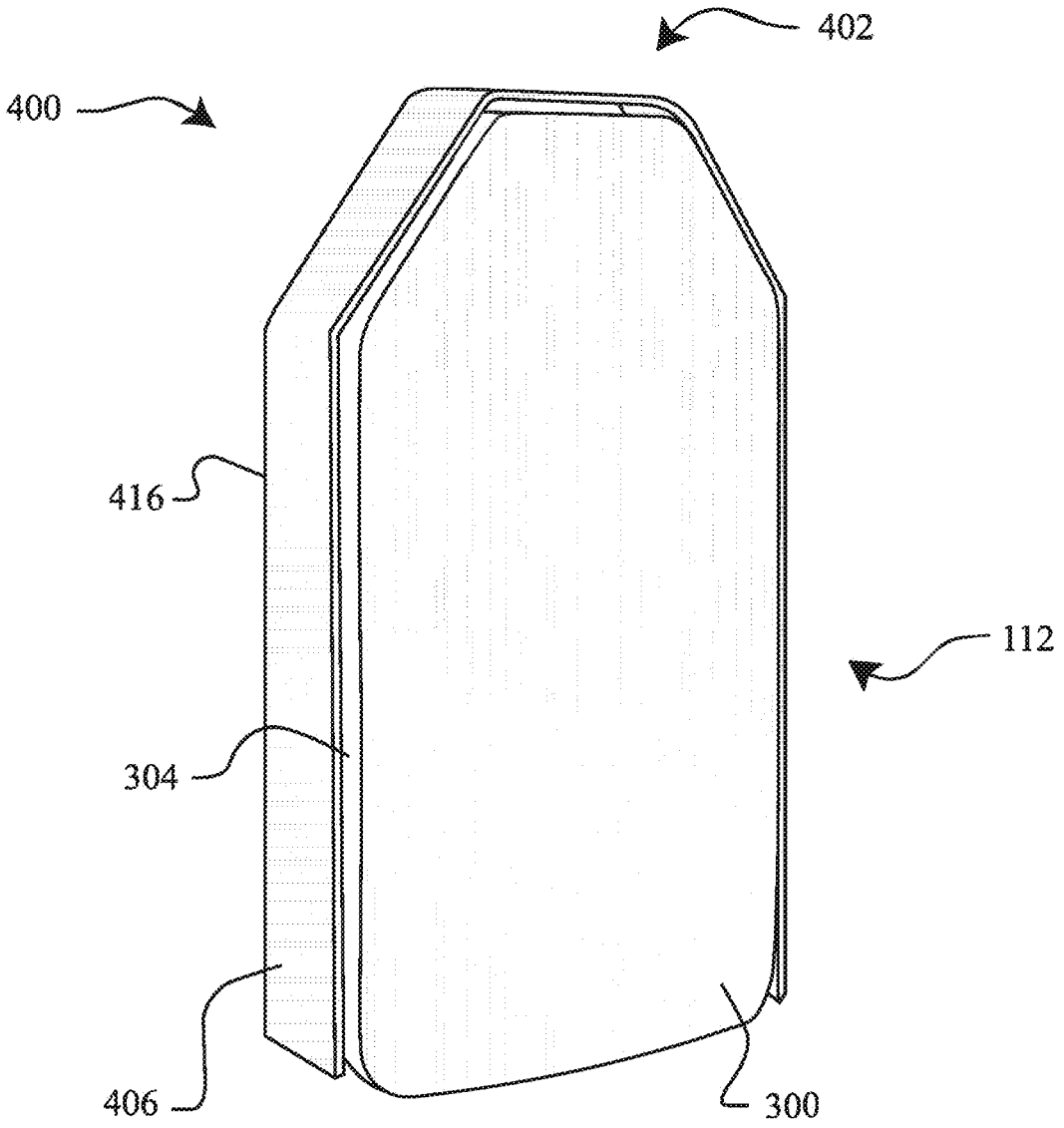
FIG. 8 illustrates the ballistic plate cover engaged to the ballistic plate.
Figure 8A:
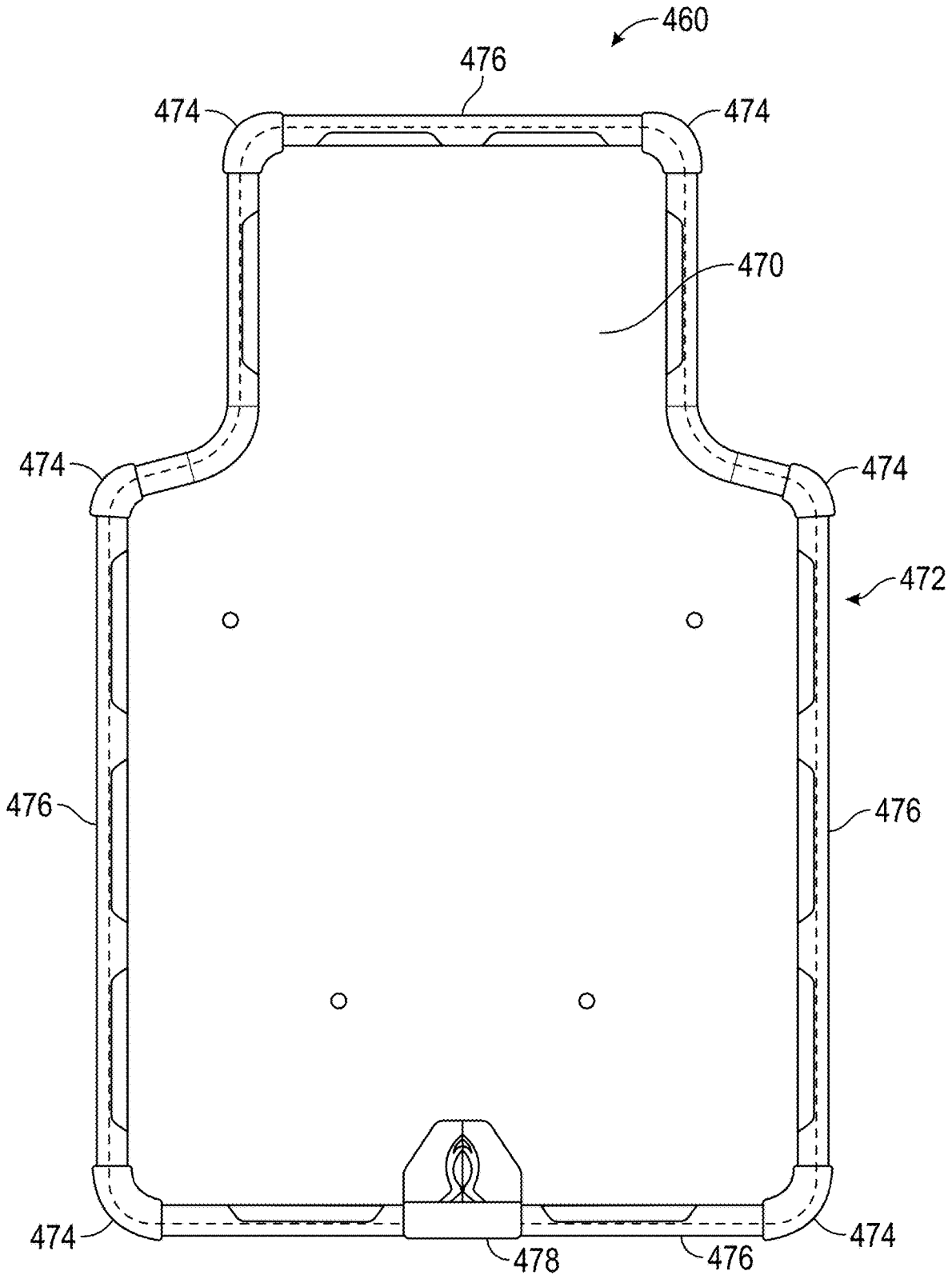
FIG. 8A illustrates a front view of a shield system with an edge protection system, in accordance with various embodiments.
Figure 8B:
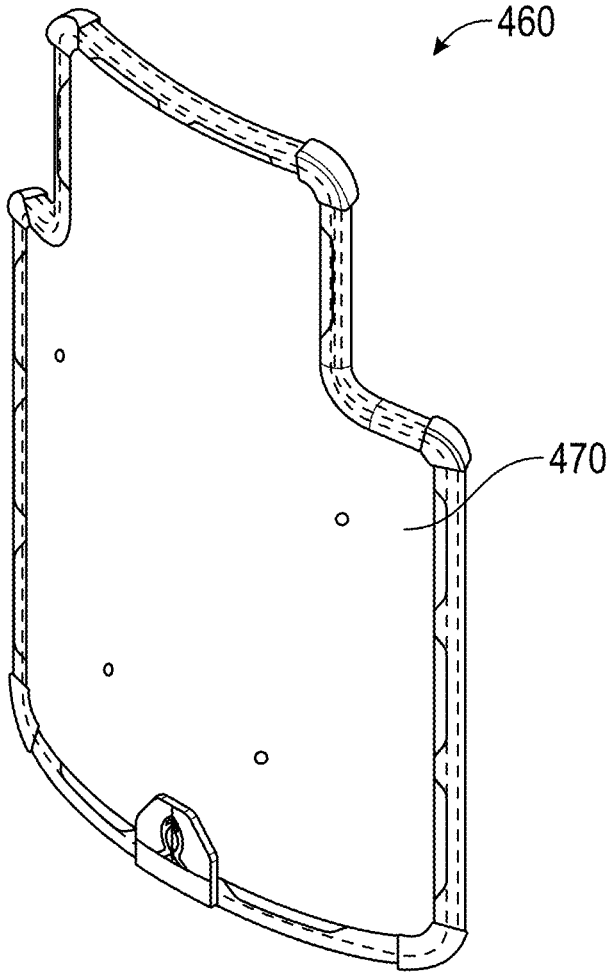
FIG. 8B illustrates a front perspective view of a shield system with an edge protection system, in accordance with various embodiments.

As shown in FIG. 8, in one implementation, the receiving portion 420 engages the ballistic plate 112, such that at least a portion of the peripheral edge 304 is covered. In the example shown in FIG. 8, the peripheral portion of the ballistic plate cover 400 covers side portions and a proximal portion of the peripheral edge 304 with a distal portion left exposed. Further, the receiving portion 420 may engage the ballistic plate 112 such that at least a portion of the peripheral area of the strike face 300 and/or the back face 302 is covered. In the example shown in FIG. 8, the back portion 416 covers at least a portion of the peripheral area of the back face 302 along the portions of the peripheral edge 304 covered by the peripheral portion of the ballistic plate cover 400.

In another implementation with reference to FIGS. 8A-8E, shield system 460 may comprise a shield 470 and an edge protection system 472. Edge protection system 472 may be any system configured to protect a shield edge from damage due to impact. Edge protection system 472. Edge protection system 472 may provide similar capability to shield 470 as ballistic plate cover 400 provides to ballistic plate 112 as discussed in this disclosure. Like ballistic plate cover 400 described wherein, edge protection system 472 may wrap around at least a portion of the peripheral area of the shield 470 to provide additional protection against back face deformation and/or side spall created by augmentation of shield 470. Back face deformation occurs when a ballistic projectile impacts the strike face of shield 470 (e.g., the front of shield 470) and causes the back face of shield 470 to deform or bulge outwardly. Side spall occurs when a ballistic projectile impacts the peripheral area of the shield 470 such that shrapnel from the ballistic projectile impact and/or debris of material from the impacted portion of the shield 470 potentially injure the user.

In various embodiments, Edge protection system 472 may comprise one or more corner protectors. Edge protection system 472 may also comprise one or more edge protector portions 476. Edge protection system 472 may comprise a plurality of edge protector portions 476 and corner protectors 474. Corner protector 474 may be positioned at each corner location of shield 470. Corner protector 474 may also have a profile that is larger than edge protector portions 476. In this regard, corner protector 474 may be configured to absorb shocks at a corner location of shield 470. This shock absorbing capability protects the edges of the shield 470. This protection maintains the integrity and ballistic capability of shield 470.

In various embodiments, edge protection system 472 may be an injection molded plastic or rubber material. Edge protection system 472 may also be made from any suitable material that is configured to receive a force or impact and dispersed the force or impact. Edge protection system 472 may also be molded, performed, or otherwise defined to have a profile that makes it installable along the perimeter or outer edge of shield 470. In this regard, edge protection system 472 may be adapted, operatively coupled to, and/or installed on and follow the profile of shield 470.

In various embodiments, edge protection system 472 may comprise a single injection molded assembly or a plurality of separately molded edge protector portions 476 and corner protectors 474. Edge protection system 472 may be fitted to shield 470. Moreover, edge protection system 472 may be operatively coupled and/or glued to shield 470. In an embodiment, edge protection system 472 may comprise a plurality of edge protector portions 476, with a plurality of corner protectors 474 disposed between each edge protector portion 476 at corner locations of the shield. Edge protection system 472 may be a single piece that is fitted around the perimeter of shield 470 such that the ends of edge protection system 472 may at a particular location on shield 470. The ends of edge protection system 472 may be coupled together by edge coupling 478.

Figure 8C:
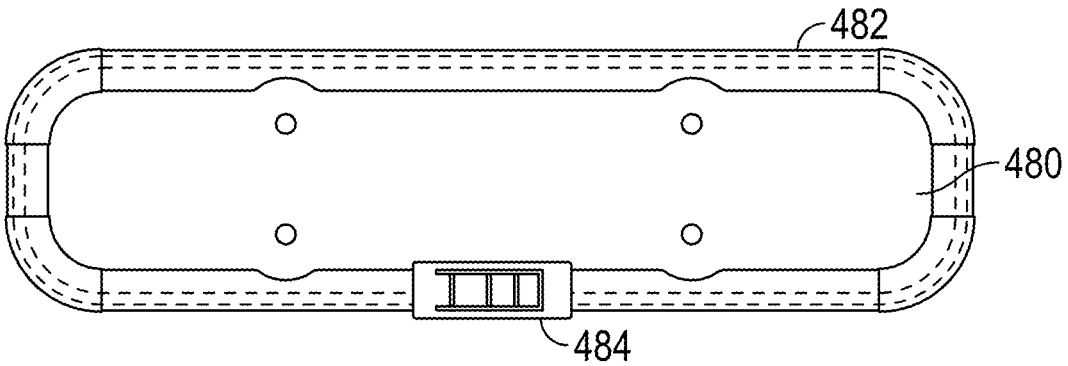
FIG. 8C illustrates a front view of a shield cover with an edge protection system, in accordance with various embodiments.

In various embodiments and with reference to FIG. 8C, edge protection system 482 may be configured to surround the perimeter of a shield cover 480. Shield cover 480 may be used as part of a larger shield system as described herein to protect the user and fill voids created in a shield assembly. Edge protection system 482 may be a single piece that is fitted around the perimeter of shield cover 480 such that the ends of edge protection system 482 may at a particular location on shield cover 480. The ends of edge protection system 482 may be coupled together by edge coupling 484.

Figure 8D:
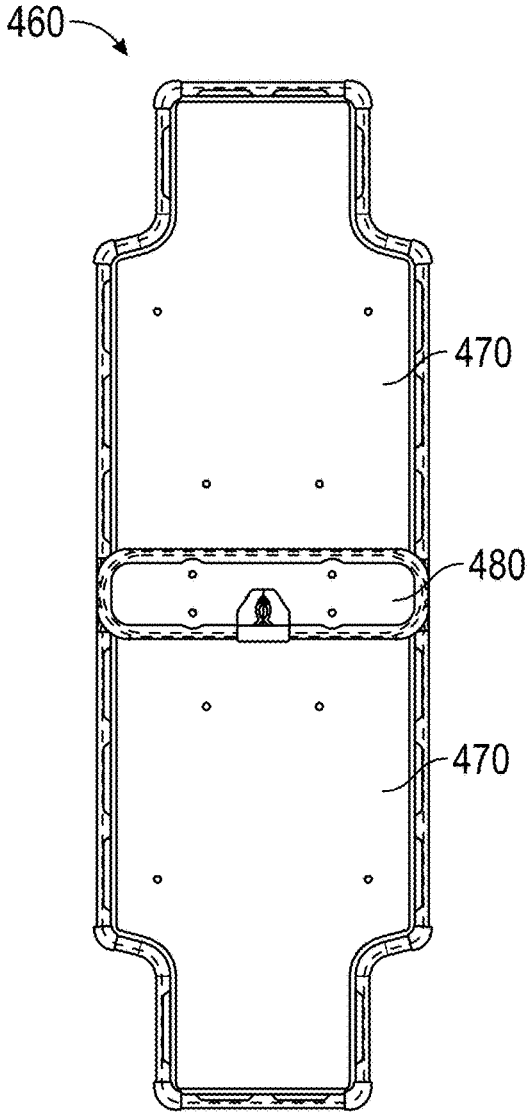
FIG. 8D illustrates a front view of a ballistic shield system assembly with an edge protection system, in accordance with various embodiments.
Figure 8E:
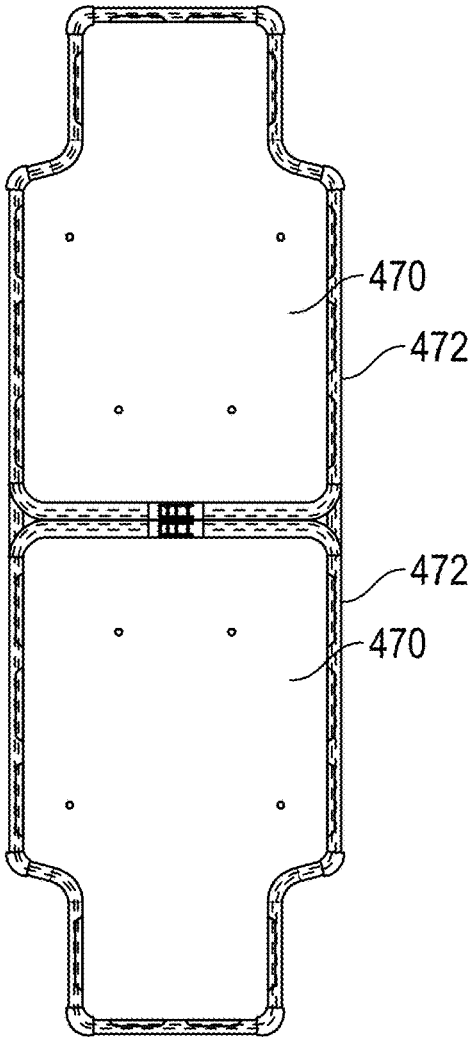
FIG. 8E illustrates a back view of a ballistic shield system assembly with an edge protection system, in accordance with various embodiments.

In various embodiments and with reference to FIGS. 8D, and 8E, shield system 460 may comprise one or more shields 470 and a shield cover 430. Each shield for 410 may comprise an exit edge protection system for 420 comprising edge protector portions 424 and corner protectors 474. Moreover shield system 460 may comprise a shield cover that includes an edge protection system 440. Shield system 460 may be deployed with TYR Tactical's ballistic appliqué which is described in U.S. Ser. No. 16/018,052 filed on Jun. 26, 2018 and entitled Shield System, which is hereby incorporated by reference for any reason. Shield system 460 may be deployed with TYR Tactical's ballistic dolly which is described in U.S. Ser. No. 15/896,840 filed on Feb. 14, 2018 and entitled Ballistic Dolly System, which is hereby incorporated by reference for any reason.

Figure 9:
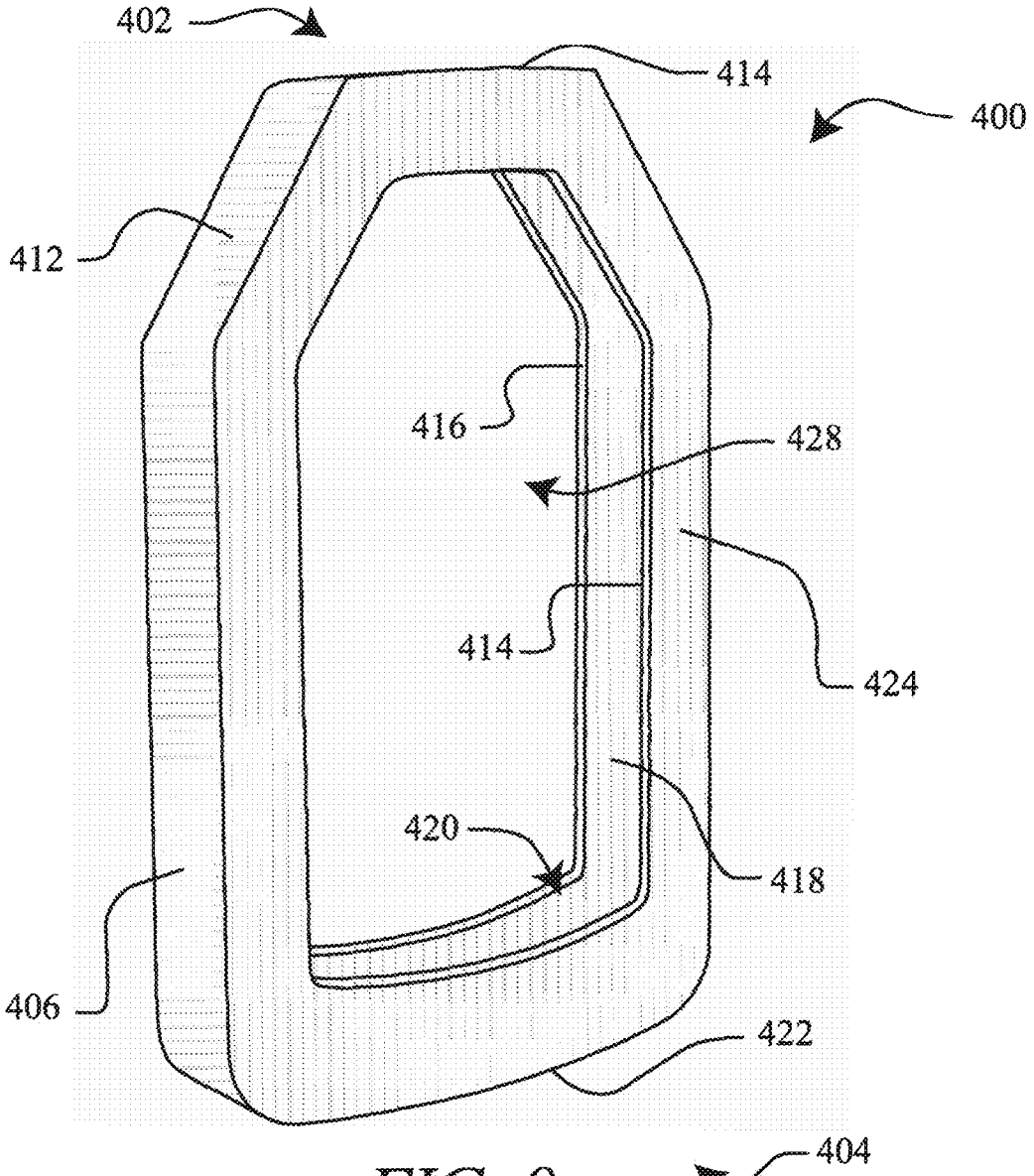
FIG. 9 is a perspective view of another example ballistic plate cover of the tactical system.

As can be understood from FIG. 9, in one implementation, the body of the ballistic plate cover 400 further includes a bottom portion 422 of the peripheral portion disposed opposite the top portion 414 and a front portion 424 disposed opposite the back portion 416. The front portion 424 is connected to the peripheral portion. For example, the front portion 424 may be connected at an edge of the peripheral portion, such that the front portion 424 is disposed inwardly from the side portions 406, the tapered portions 412, and/or the top portion 414 and parallel to the back portion 416.

The front portion 424 includes an inner front surface 426 facing the inner back surface 418. In one implementation, the inner front surface 426 is disposed at an angle relative to the inner peripheral surface 410 and parallel to the inner back surface 418. For example, the inner back surface 418 and the inner front surface 424 may each be disposed perpendicularly to the inner peripheral surface 410. The inner back surface 418, the inner front surface 424, and the inner peripheral surface 410 collectively form the receiving portion 420. As can be understood from FIG. 9, in one implementation, the receiving portion 420 engages the ballistic plate 112, such that an entirely of the peripheral edge 304 is covered. Further, the receiving portion 420 may engage the ballistic plate 112 such that an entirety of the peripheral area of the strike face 300 and/or the back face 302 is covered. In the example of FIG. 9, the back portion 416 covers an entirety of the peripheral area of the back face 302 and the front portion 424 covers an entirety of the peripheral area of the strike face 300. In one implementation, the body of the ballistic plate cover 400 defines an opening 428 exposing the non-peripheral area 306 of the ballistic plate 112.

Figure 10:
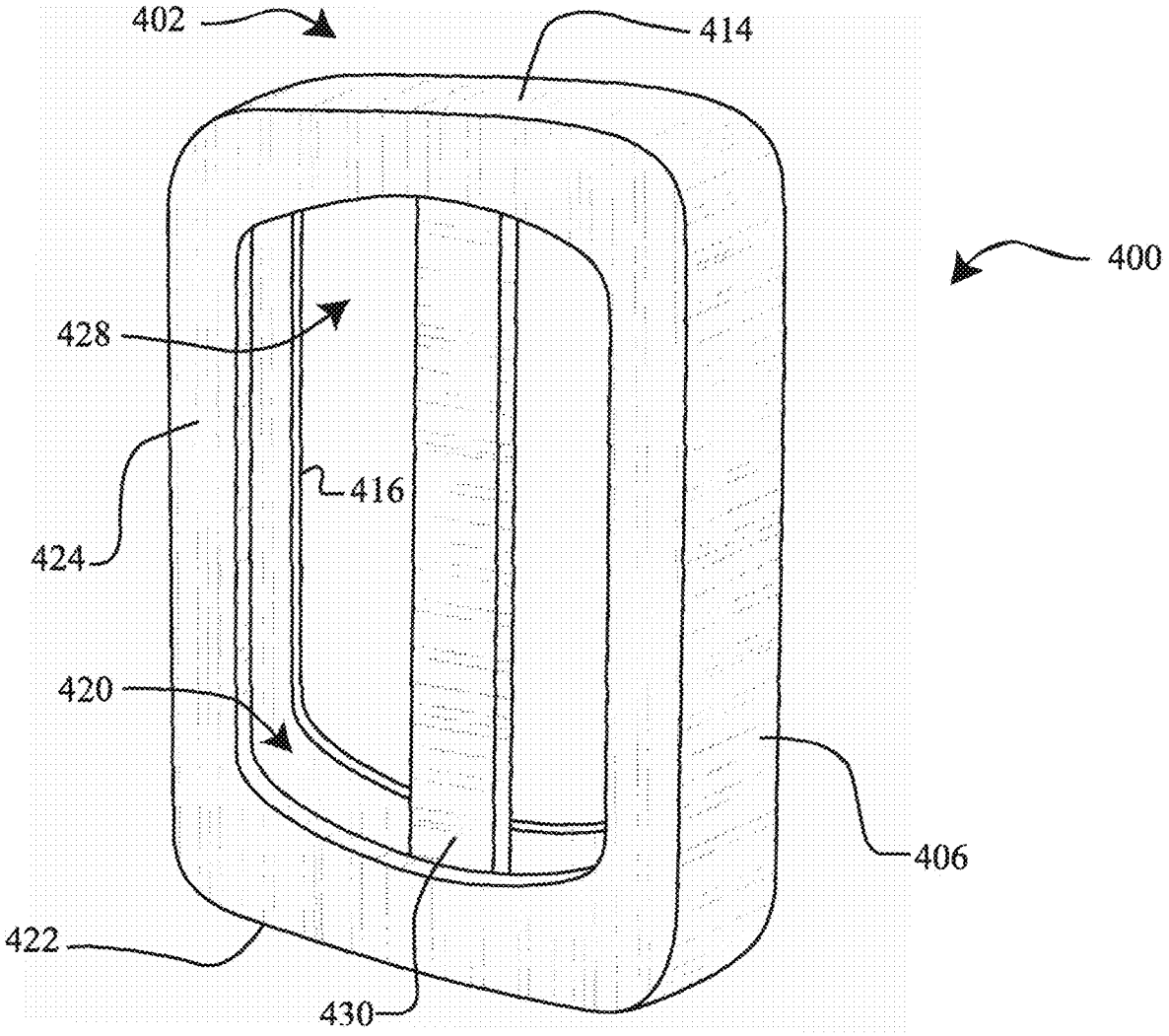
FIG. 10 is a perspective view of another example ballistic plate cover of the tactical system.
Figure 11A:
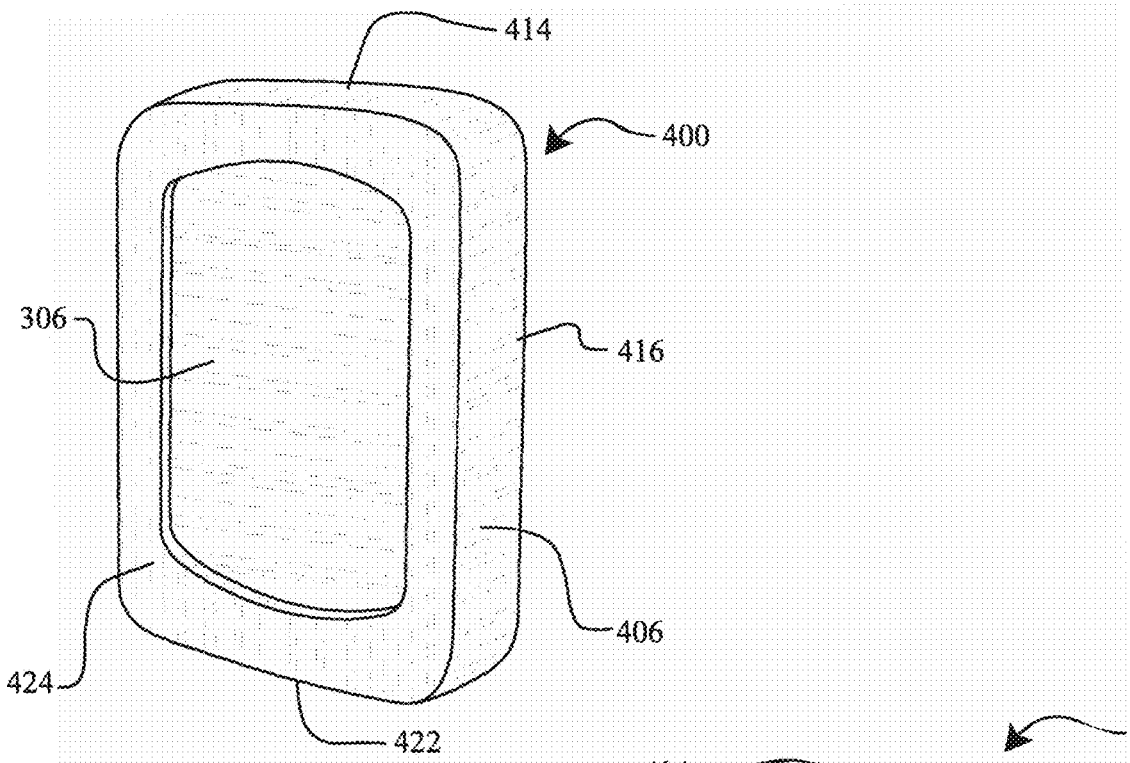
FIGS. 11A and 11B show front perspective and back perspective views of the ballistic plate cover of FIG. 10.
Figure 11B:
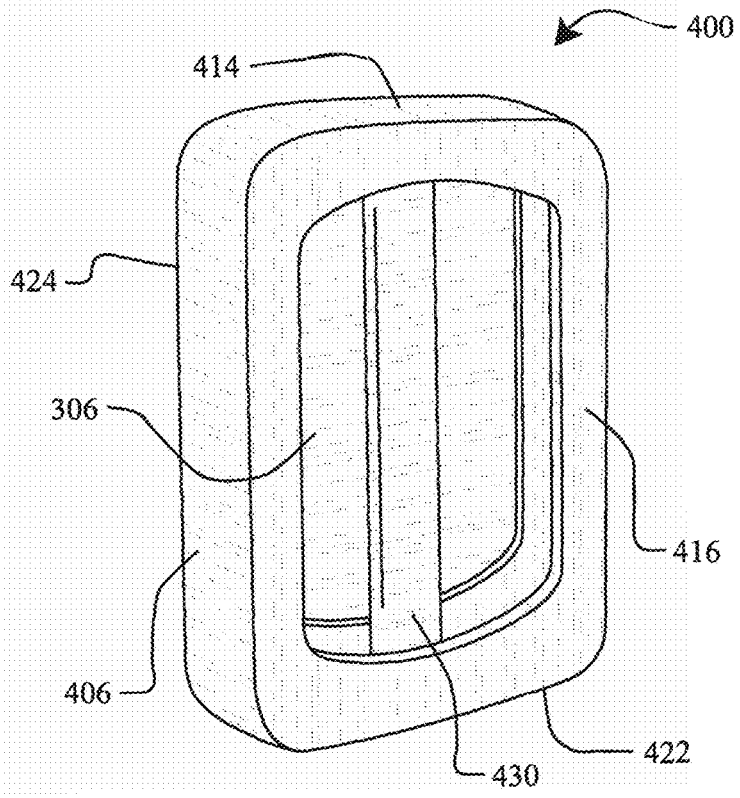
Figure 12:
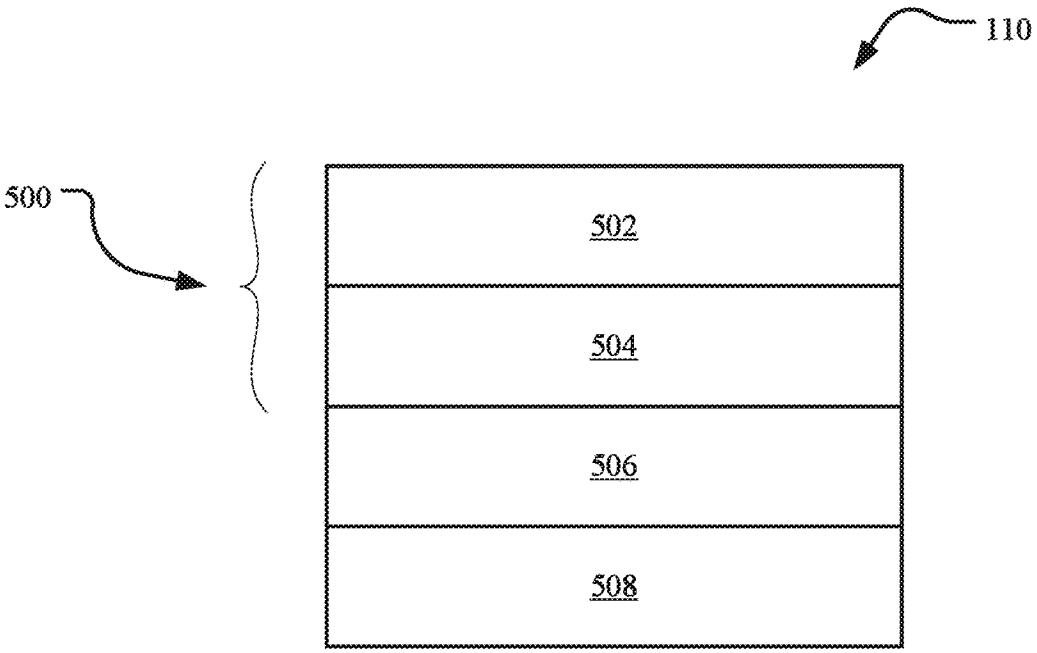
FIG. 12 illustrates example panels of a ballistic filler for a flexible body armor, including a first panel, a second panel, and a third panel.

Turning to FIGS. 10-11B, in one implementation, the body of the ballistic plate cover 400 further includes one or more middle portions 430 extending between the top portion 414 and the bottom portion 414. The middle portion 430 may be engaged to the inner back surface 418 and/or the inner front surface 424. The middle portion 430 provides further structural support to maintain the ballistic plate 112 within the receiving portion 420 of the ballistic plate cover 400.

As discussed herein, the body of the ballistic plate cover 400 may have a variety of shapes, including, but not limited to, rectangular, circular, elliptical, triangular, polygonal, angles, contoured, and/or the like. In the example shown in FIG. 10-11B, the body of the ballistic plate cover 400 has a rectangular shape with the peripheral portion including side portions 406 extending linearly between the top portion 414 and the bottom portion 422. Portions or an entirety of the body of the ballistic plate cover 400 may be made from aramid/unidirectional material and/or a stretchable fabric composite material and may be stitched or otherwise connected or be of unitary construction. In one implementation, the ballistic plate cover 400 includes a soft armor padding disposed in one or more places and made from a similar material to the flexible body armor 110.

For a detailed description of an example of the flexible body armor 110, reference is made to FIGS. 12-20. As can be understood from FIG. 12, in one implementation, ballistic filler for the flexible body armor 110 includes a first panel 500 having a first subpanel 502 and a second subpanel 504, a second panel 506, and a third panel 508.

Figure 13:
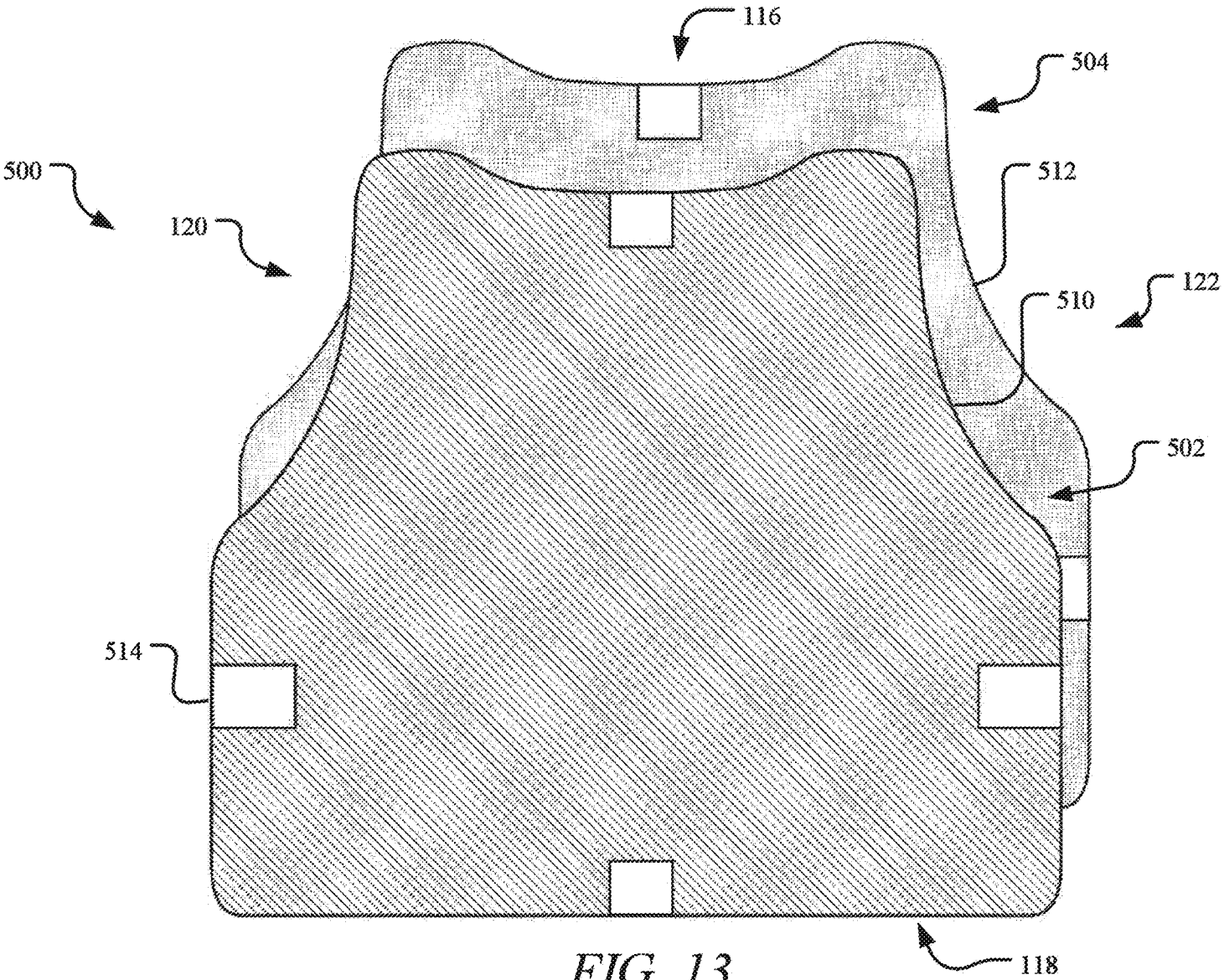
FIG. 13 illustrates the first panel of the ballistic filler, including a first subpanel of woven fabric and a second subpanel of unidirectional laminates.

Referring to FIG. 13, in one implementation, the first panel 500 of the ballistic filler of the flexible body armor 110 includes the first subpanel 502 as a plurality of layers of woven fabric generated from UHMWPE fiber and a second subpanel 504 as a plurality of layers of unidirectional laminate. In one particular implementation, the first subpanel 502 comprises three layers 510 of JPS 17517 woven fabric, and the second subpanel 504 comprises four layers 512 of SB117 unidirectional laminates. Tape 514 holds the layers 510 of the first subpanel 502 together and holds the layers 512 of the second subpanel 504 together.

Figure 14:
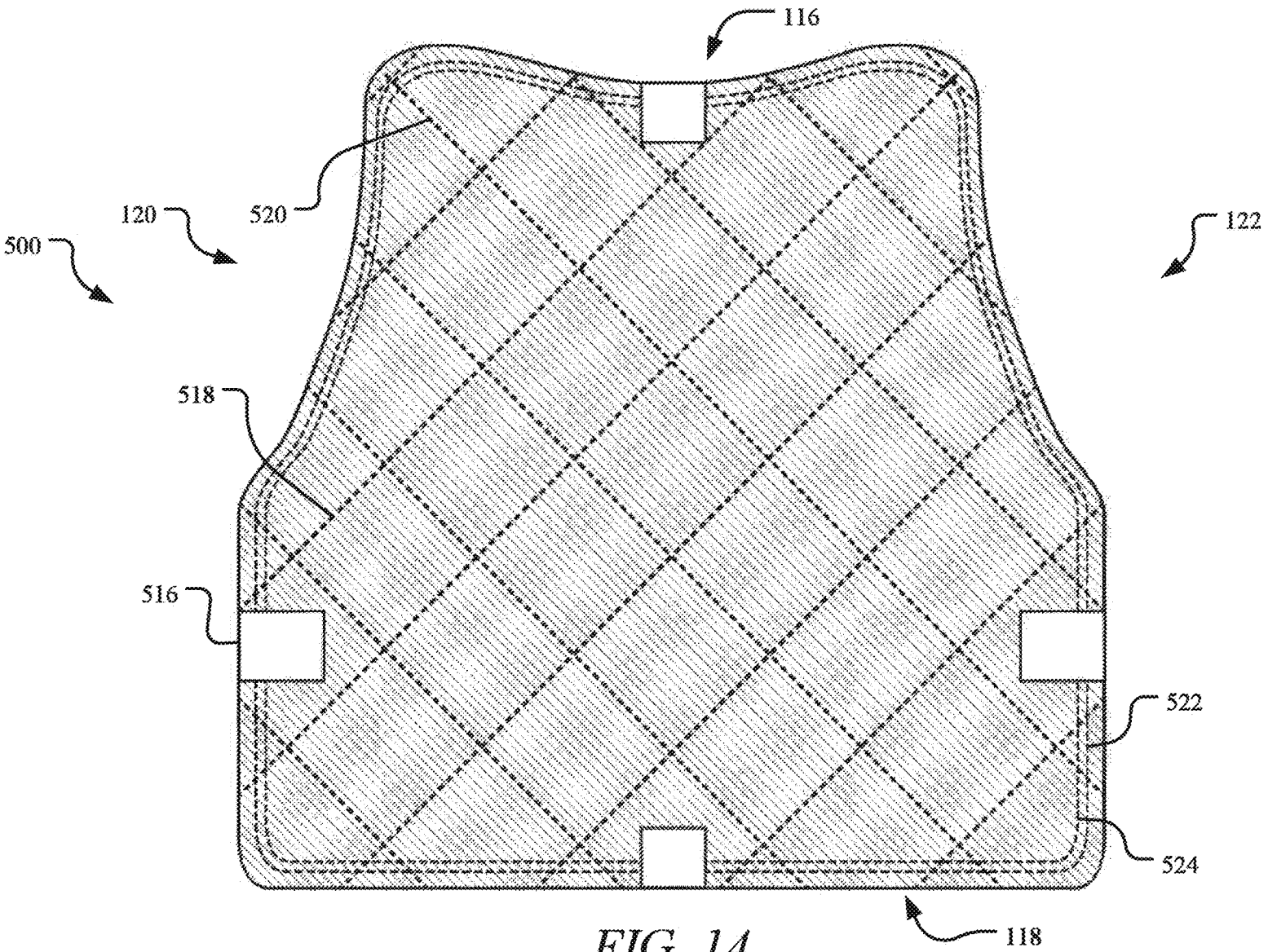
FIG. 14 depicts the first panel of the ballistic filler with the first subpanel stitched directly to the second subpanel.

Turning to FIG. 14, in one implementation, the first subpanel 502 is stitched directly to the second subpanel 504 to form the first panel 500. The first subpanel 502 is backed by the second panel 504. Tape 516 disposed at one or more of the edges may hold the first subpanel 202 to the second subpanel 204 during stitching.

In one implementation, the stitching comprises a first set of stitching lines 518 parallel to each other and oriented in a first direction and a second set of stitching lines 520 parallel to each other and oriented in a second direction. The first direction may be perpendicular to the second direction to form a quilted square pattern. In one implementation, the first direction and the second direction are both diagonal relative to the proximal end 116 and the distal end 118. Other stitching methods and arrangements are contemplated. In one implementation, a first edge stitching 522 and a second edge stitching 524 extend around a perimeter of the first panel 500 at a distance from the edge (e.g., approximately¼ inches and½ inches from the edge with +/−⅛ inches apart).

Figure 15:
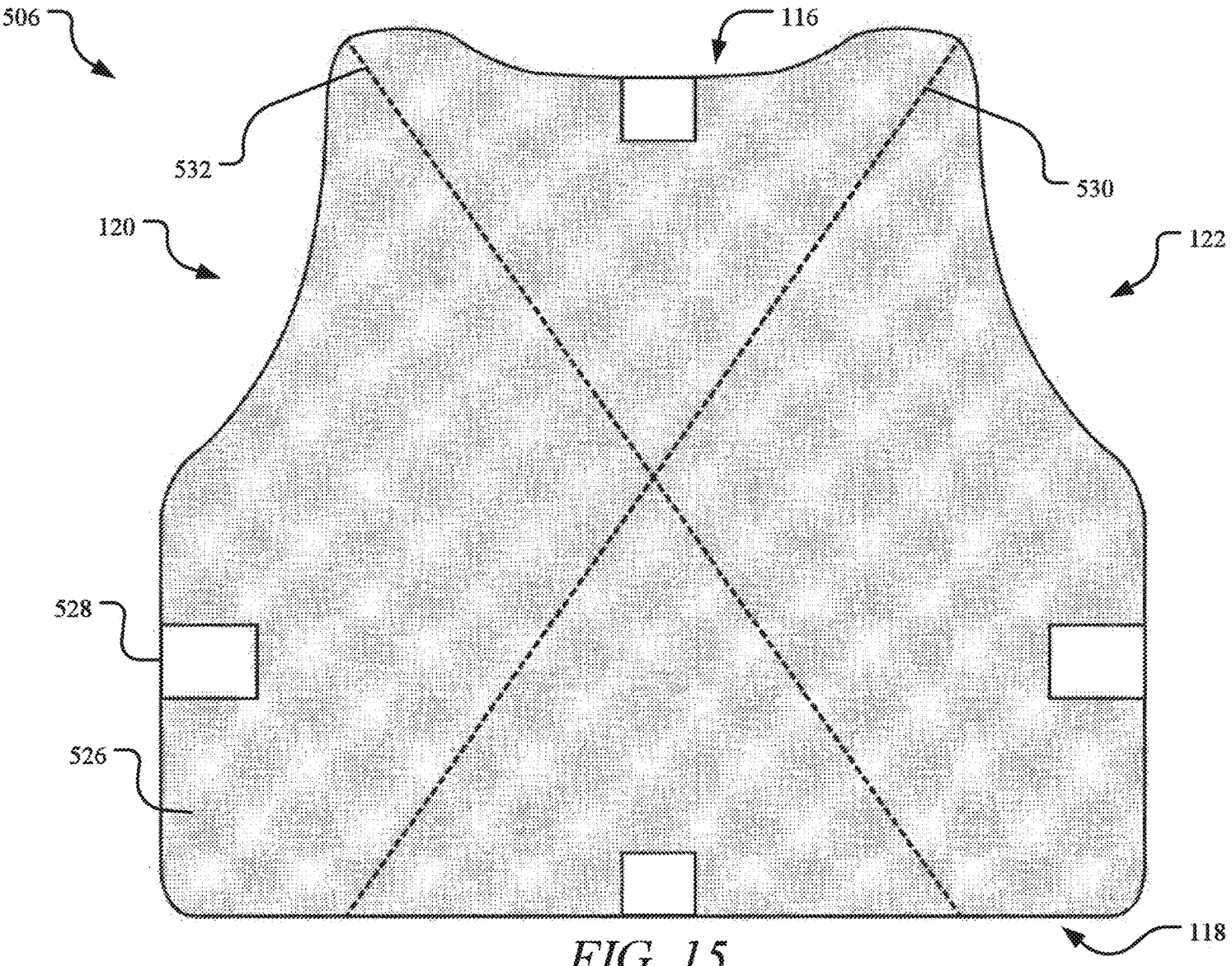
FIG. 15 shows the second panel of the ballistic filler formed from a plurality of stitched layers of unidirectional laminates.

Turning to FIG. 15, the second panel 506 of the ballistic filler for the flexible body armor 110 is shown. In one implementation, the second panel 506 is formed from a plurality of layers 526 of unidirectional laminates. In one implementation, the plurality of layers 526 is fifteen layers of SB115. The plurality of layers 526 may be held together with tape 528 for stitching. In one implementation, the stitching comprises a first stitching line 530 and a second stitching line 532. The stitching lines 530 and 532 form an "X' shape across the plurality of layers 526 from the proximal end 116 to the distal end 118, with the ends spaced an equal distance such that if the proximal and distal end points of the stitching lines 530 and 532 were joined a rectangle would be formed.

Figure 16:
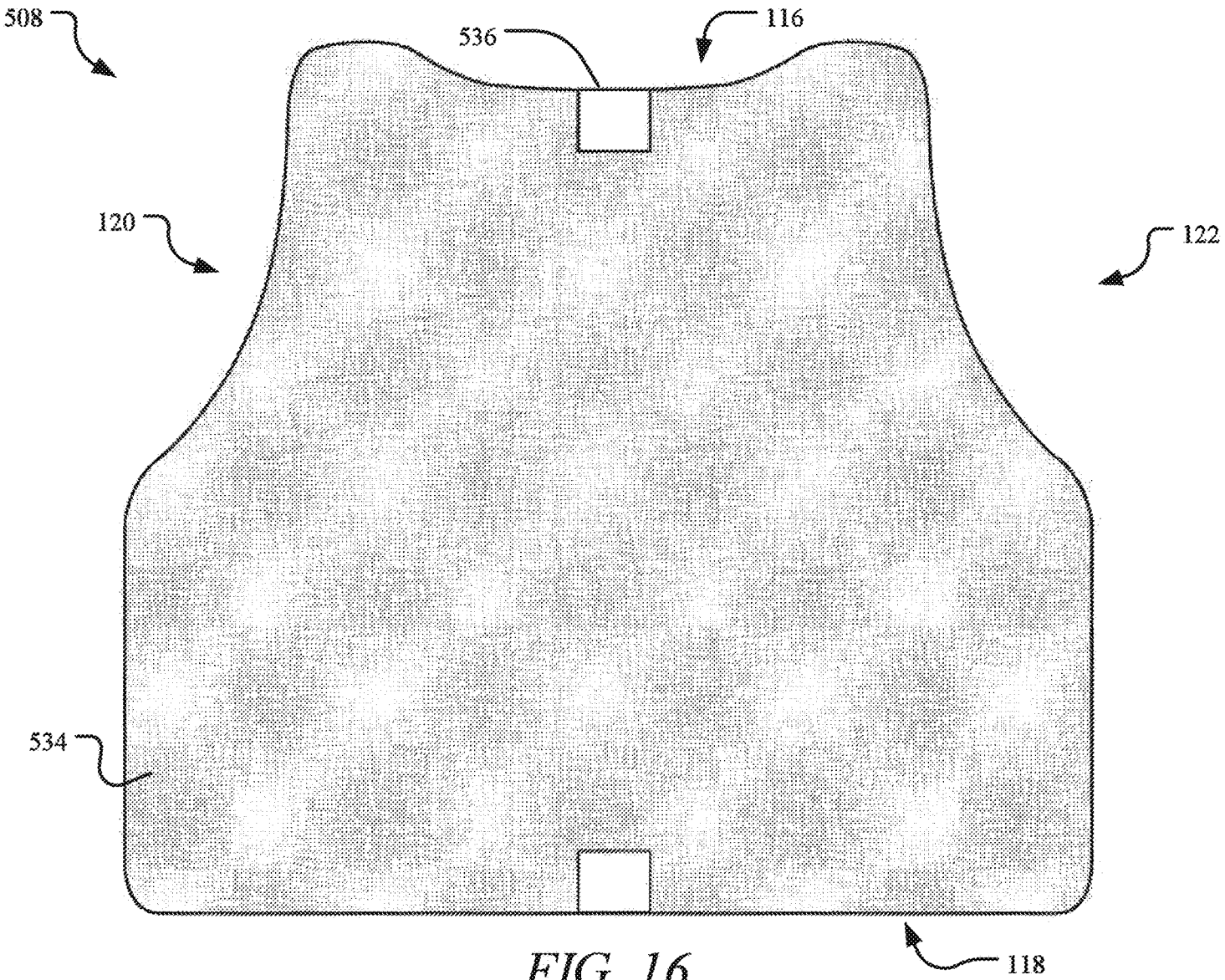
FIG. 16 illustrates the third panel of the ballistic filler formed by a plurality of layers of unidirectional laminates.
Figure 17:
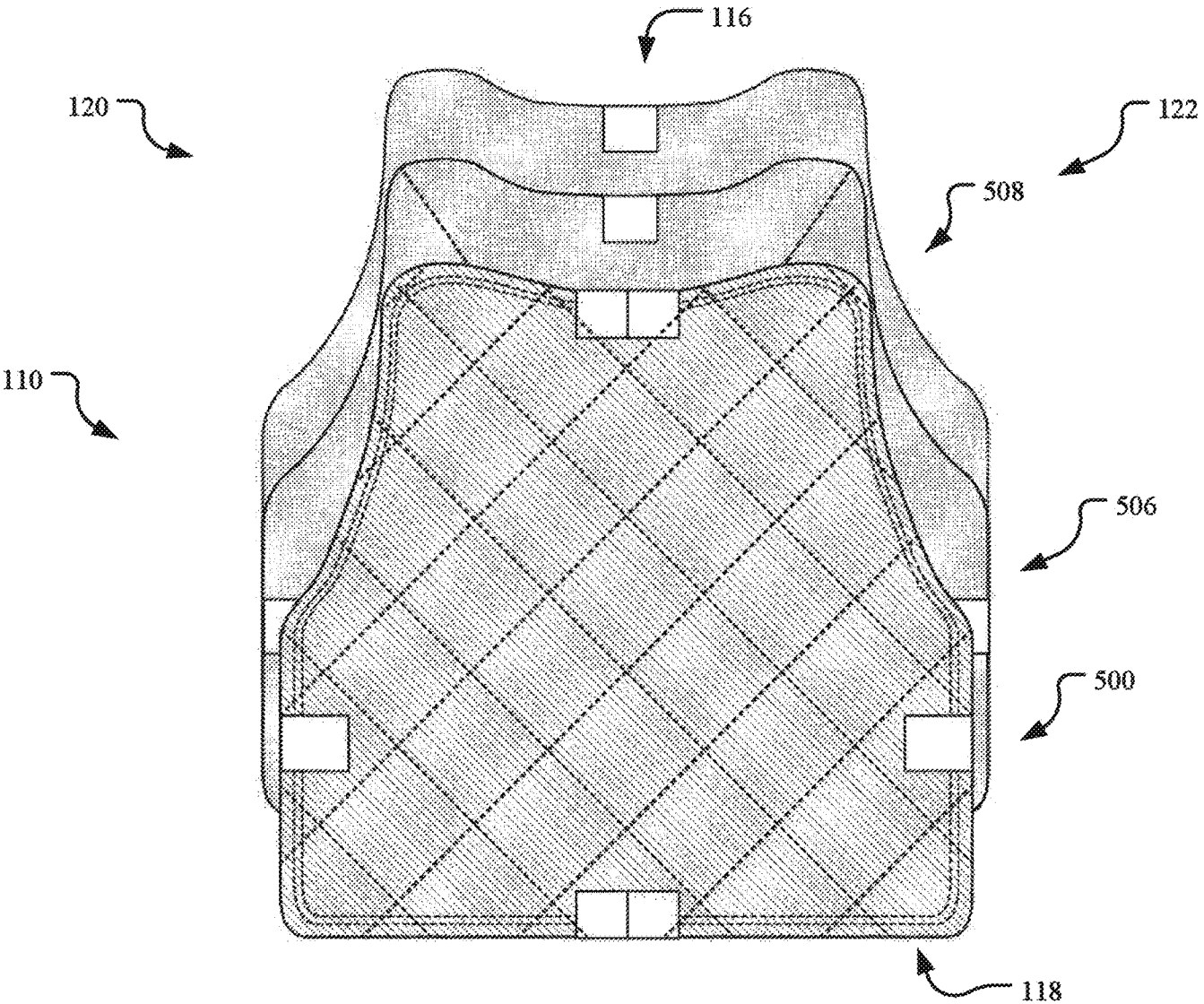
FIG. 17 depicts a ballistic arrangement of the ballistic filler, including the first panel backed by the second panel, which is backed by the third panel.
Figure 18:
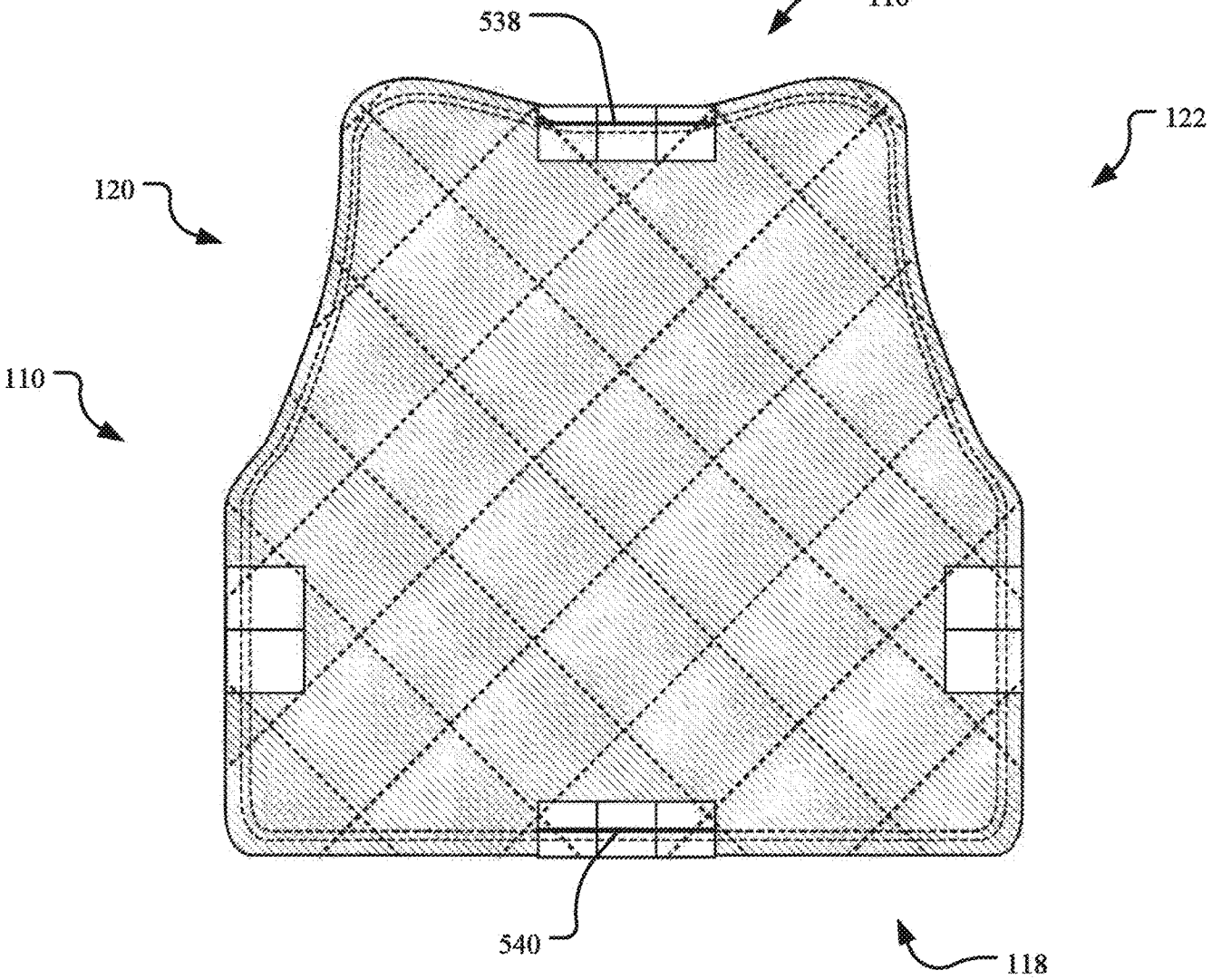
FIG. 18 shows the ballistic filler with the first panel, the second panel, and the third panel connected using closure stitching.
Figure 19:
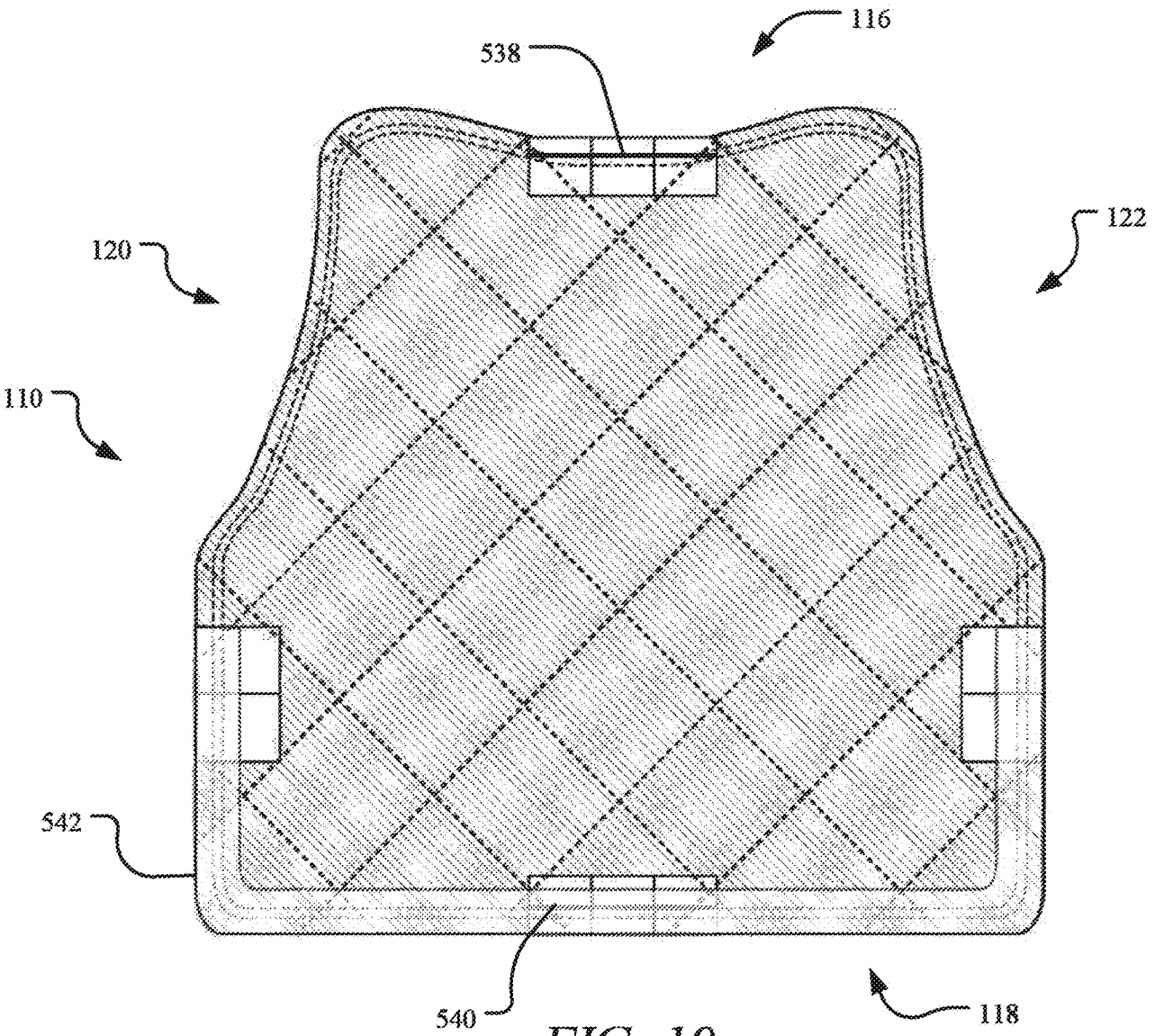
FIG. 19 illustrates edge tape applied to a portion of a periphery of the ballistic filler for heat sealing.

FIG. 16 illustrates the third panel 508 of the ballistic filler for the flexible body armor 110 formed by a plurality of layers 534 of unidirectional laminates. In one implementation, the plurality of layers 534 is two layers of SB117. The plurality of layers 534 are not sewn and are held together with tape 536 for combining with the first panel 500 and the second panel 506. As shown in FIG. 17, a ballistic arrangement of the ballistic filler for the flexible body armor 110, includes the first panel 500 backed by the second panel 506, which is backed by the third panel 508, such that the subpanel 502 of the woven fiber is the layer most proximal to the strike face towards the outer layer 106. FIG. 18 illustrates the ballistic filler for the flexible body armor 110 with the first panel 500, the second panel 506, and the third panel 508 connected using proximal closure stitching 538 and distal closure stitching 540 disposed at the proximal end 116 and the distal end 118, respectively. In one implementation, the closure stitching 538 and 540 comprises two passes of three inch 0/C 1.5 inches left and right. As shown in FIG. 19, edge tape 542 may be applied to a portion of a periphery of the ballistic filler for the flexible body armor 110 for heat sealing.

Figure 20:
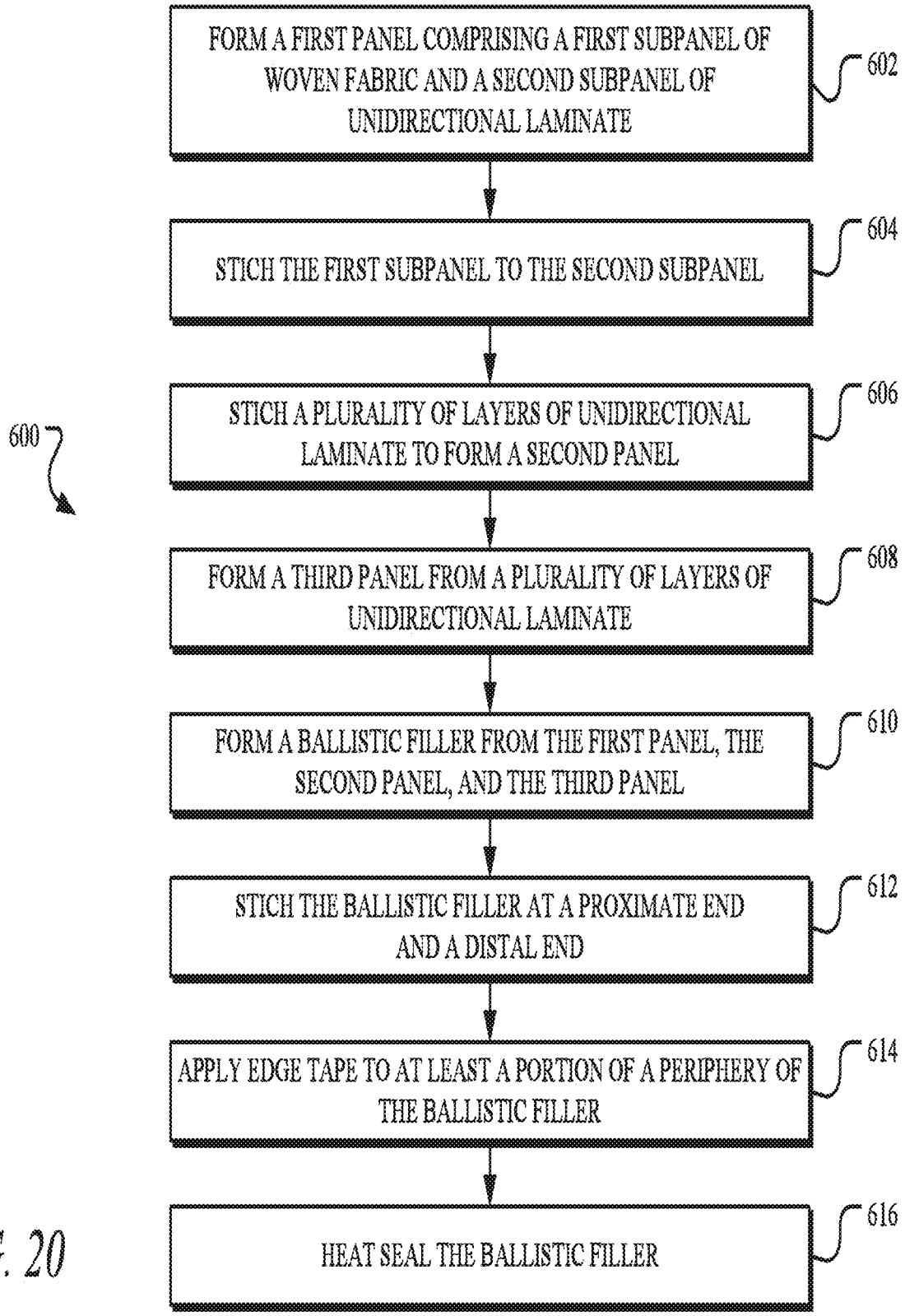
FIG. 20 illustrates example operations for manufacturing a ballistic filler.

FIG. 20 illustrates example operations 600 for manufacturing a ballistic filler for the flexible body armor 110. In one implementation, an operation 602 forms a first panel comparison a first subpanel of woven fabric and a second subpanel of unidirectional laminate. An operation 604 stitches the first subpanel to the second subpanel. An operation 606 stitches a plurality of layers of unidirectional laminate to form a second panel, and an operation 608 forms a third panel from a plurality of layers of unidirectional laminate. An operation 610 forms a ballistic filler from the first panel, the second panel, and the third panel, and an operation 612 stitches the ballistic filler at a primal end and a distal end. An operation 614 applies edge tape to at least a portion of a periphery of the ballistic filler, and an operation 616 heat seals the ballistic filler to form the flexible body armor 110.

The ballistic filler for the flexible body armor 110 provides numerous advantages over monolithic and other hybrid designs. For example, the flexible body armor is comfortable, durable, flexible, lightweight, and provides increased performance, including resistance to ballistic penetration, back face deformation performance, resistance to mechanical fatigue, and resistance to fragmentation threat, and the like.

In one implementation, the ballistic filler of the flexible body armor 110 has distinct regions. At least one region comprises a stitch consolidated assembly of one or more plies of woven fabric generated from UHMWPE yarn disposed in front of one or more flexible ballistic ply structures generated from a high strength yarn. The flexible ballistic ply structures may be, for example, a resin impregnated woven fabrics, unidirectional laminates, multi-axial fabrics, and/or the like. In one implementation, the flexible ballistic ply structures can be generated using high strength yarns including, without limitation, aromatic polyamides such as poly(p-phenylene teraphthalamide), poly(metaphenylene isophthalam ide), p-phenylenebenzobisoxazole, polybenzoxazole, polybenzothiazole, aromatic unsaturated polyesters such as polyethylene terephthalate, aromatic polyimides, aromatic polyamideimides, aromatic polyesteramideimides, aromatic polyetheramideimides and aromatic polyesterimides or copolymers of any of the above mentioned classes of materials, and ultra-high molecular weight polyethylene, or any combination of these yarns. In another implementation, the flexible ballistic ply structures are woven fabrics generated from high strength fiber are woven structures produced using yarns containing aromatic polyamides including poly (p-phenylene teraphthalamide), poly (metaphenylene isophthalam ide), p-phenylenebenzobisoxazole, polybenzoxazole, polybenzothiazole, aromatic unsaturated polyesters such as polyethylene terephthalate, aromatic polyimides, aromatic polyamideimides, aromatic polyesteramideimides, aromatic polyetheramideimides and aromatic polyesterimides or copolymers of any of the above mentioned classes of materials or any combinations of these yarns.

In one implementation, at least one region of the ballistic filler of the flexible body armor 110 comprises one or more plies of unstitched ballistic ply structures generated from a high strength yarn, which may have a tenacity greater than about 7 grams/denier. The unstitched ballistic ply structures may include woven fabrics, resin impregnated woven fabrics, unidirectional laminates, or multi-axial fabrics generated from yarns containing aromatic polyamides including poly(p-phenylene teraphthalamide), poly(metaphenylene isophthalamide), p-phenylenebenzobisoxazole, polybenzoxazole, polybenzothiazole, aromatic unsaturated polyesters such as polyethylene terephthalate, aromatic polyimides, aromatic polyamideimides, aromatic polyesteramideimides, aromatic polyetheramideimides and aromatic polyesterimides or copolymers of any of the above mentioned classes of materials, and ultra-high molecular weight polyethylene or any combinations of these yarns.

Any one of the stitch consolidated assemblies of plies of the ballistic filler for the flexible body armor 110 is achieved using any stitching thread and any type of stitching method to achieve through-thickness connectivity of the plies, including chain stitching or lock stitching to secure all plies in the assembly together. In one implementation, a stitching pattern that is uniform across the surface of the entire assembly is used. Such a uniform stitching pattern may be, for example, a grid pattern (quilt pattern), co-linear rows of stitching, concentric circles, a spiral, and/or the like. In another implementation, the stitching pattern of any one of the stitch-consolidated assembly of plies is not uniform across the surface of the entire assembly. As described herein, the ballistic filler for the flexible body armor 110 includes a stitched consolidated region and a free ply region. In one implementation, the weight fraction of the stitch consolidated region is no greater than 50% the overall weigh of the ballistic filler. Further, the ballistic filler of the flexible body armor 110 includes at least one region of woven fabric stitched directly to unidirectional fabric.

As can be understood from FIGS. 21-24, the flexible body armor 110 may be generated for the natural shape of a female wearer, while providing a full range of motion and support and eliminating excess compression on the breast tissue.

Figure 21:
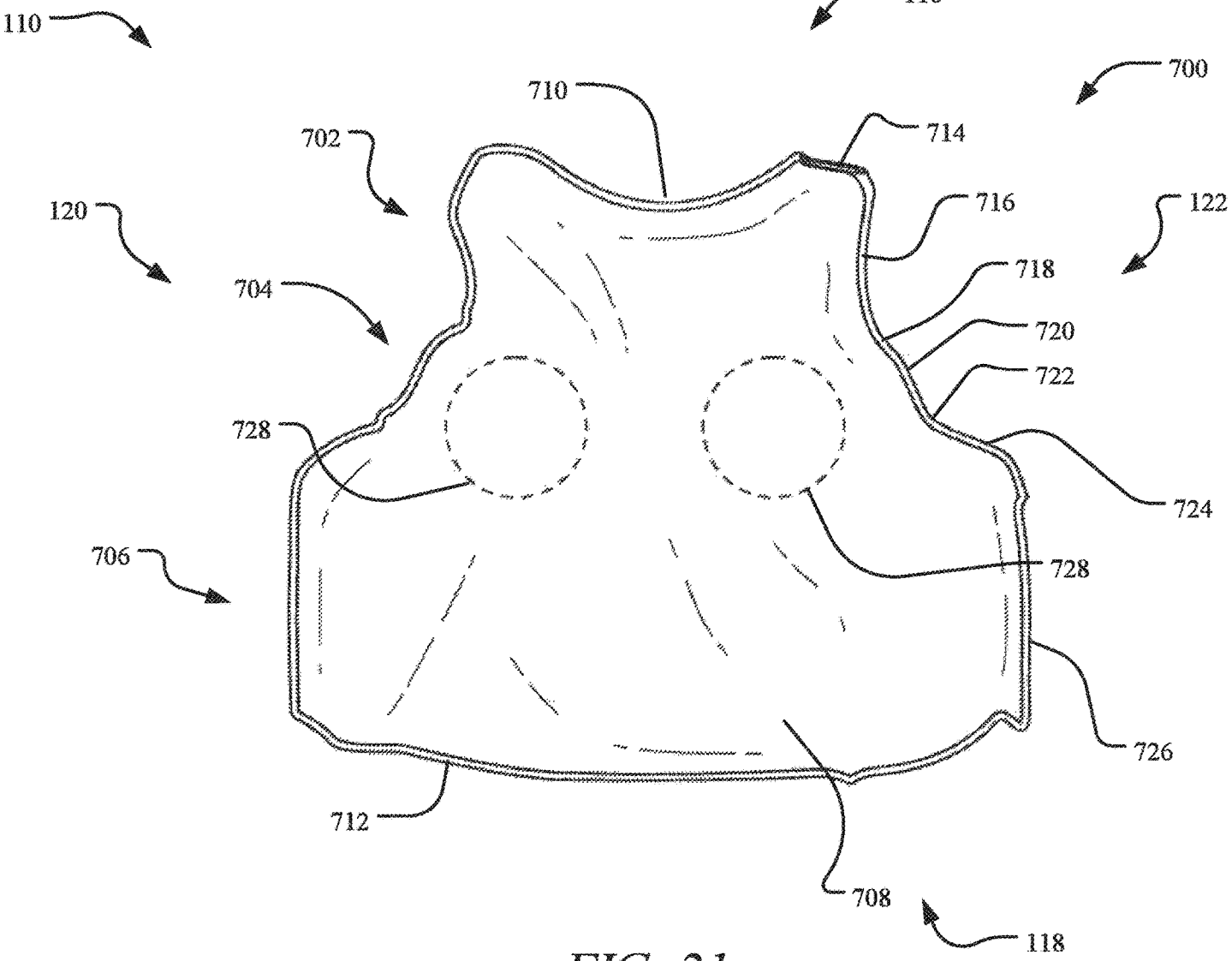
FIG. 21 shows a front view of an example flexible body armor with a female shape.
Figure 22:
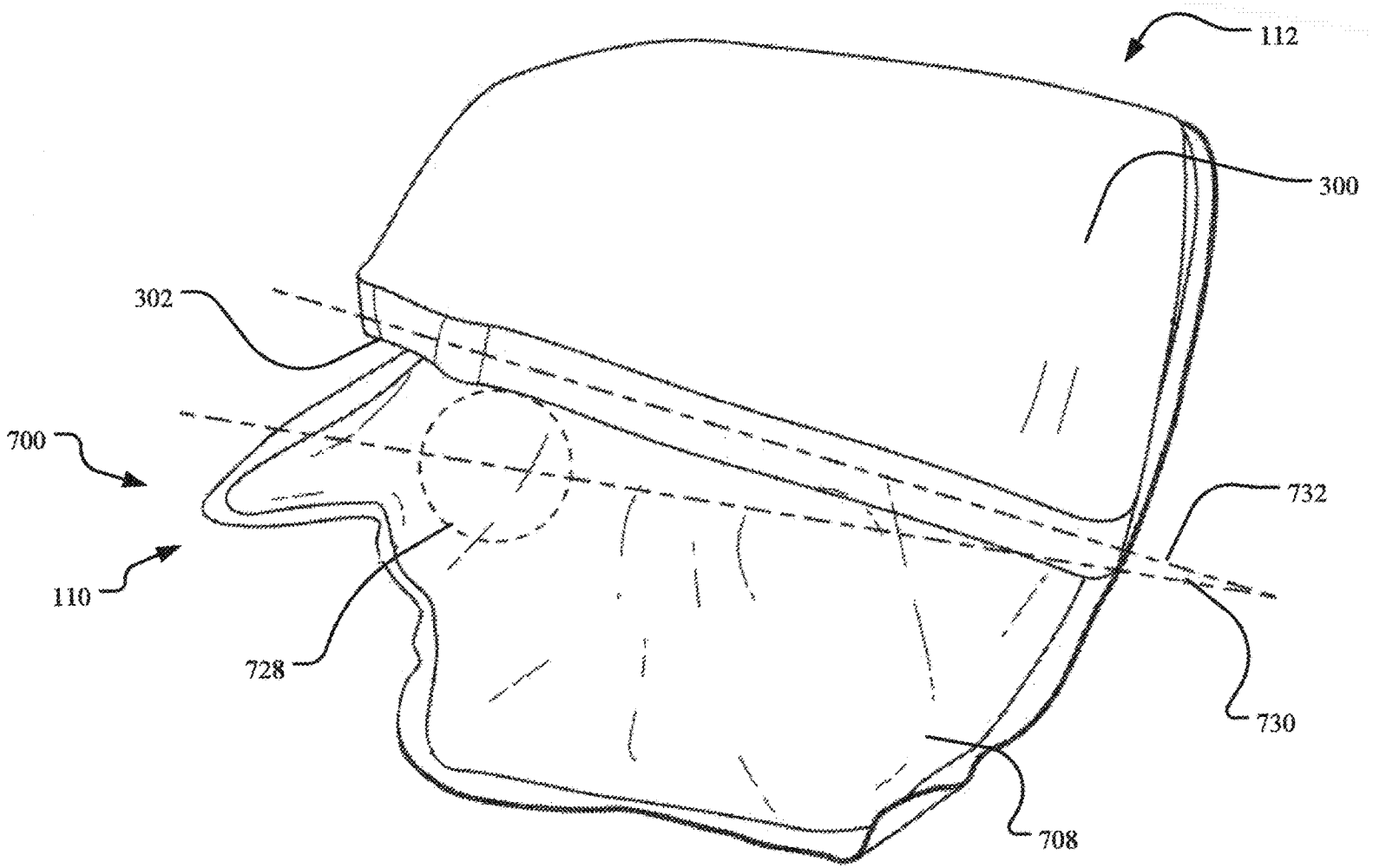
FIG. 22 illustrates the ballistic plate displaced at an angle relative to the flexible body armor of FIG. 21.

As can be understood from FIGS. 21 and 22, in one implementation, a female shape 700 of the flexible body armor 110 is formed from an upper portion 702, a set of lateral portions 704 and a lower portion 706. The set of lateral portions 704 connect the upper portion 702 to the lower portion 706.

In one implementation, the upper portion 702 includes a set of upper side edges 716 each extending distally from a top edge 714. The upper side edges 716 may further extend along a contour to enhance ergonomics and accommodate the anatomy of a female wearer. For example, the upper side edges 716 may each extend inwardly from the top edge 714 in a direction generally towards a central axis 730 extending from the proximal end 116 of the flexible body armor 110 to the distal end 118. The top edges 714 are connected by a center edge 710, which may be a contoured. In one implementation, the center edge 710 contours distally from each of the top edges 714 until reaching a central point. The top edges 714 may contour from the upper side edges 716 into the center edge 710.

In one implementation, each of the upper side edges 716 is connected to the lateral portion 704 at an upper valley 718. An edge of each of the lateral portions 704 extends from the upper valley 718 in a direction generally outwardly away from the central axis 730 to a lower valley 722. In one implementation, each of the lateral portions 704 includes a lateral peak 720. The edge of each of the lateral portions 704 may include a first edge extending from the upper valley 718 to the lateral peak 720 and a second edge extending from the lateral peak 720 to the lower valley 722. The first edge, lateral peak 720, and the second edge may extend outwardly at angle along a line, forming a generally straight-line angling from the upper valley 718 to the lower valley 722. In another implementation, the first edge contours from the upper valley 718 to the lateral peak 720, and the second edge contours from the lower valley 722 to the lateral peak 720.

The lower portion 706 is connected to the upper portion 702 with the set of lateral portions 704. In one implementation, the lower valleys 722 of the lateral portions 704 connect to a set of outwardly extending edges 724 of the lower portion 706. Stated differently, the lower valley 722 connects the second edge of the lateral portion 704 to the outwardly extending edge 724. The outwardly extending edges 724 may each be disposed at an angle relative to lower side edges 726 of the lower portion 706 and extend outwardly from the lower valleys 722 to the lower side edges 726. In one implementation, the lower side edges 726 each extend distally from the outwardly extending edges 724 to a bottom edge 712, which may extend horizontally between the lower side edges 726.

Each of the lateral portions 704 may include lateral darts extending from the edge of the lateral portion 704 inwardly and distally. In one implementation, the lateral darts form cup portions 728. As can be understood in FIG. 22, the lateral darts are each adapted to displace a ballistic hard plate 300 to eliminate excess compression on the breast tissue of the female wearer. The lateral darts displace a proximal end the body of ballistic plate 112 in a direction away from the inner surface 108 of the front carrier 124 and the flexible body armor 110 (i.e., a direction away from the wearer). As such, a central axis 732 of the ballistic plate 112 is disposed at an angle relative to the central axis 730 of the flexible body armor 110. The front carrier 124 may similarly incorporate the female shape 700, such that the ballistic plate 112 is maintained in the front carrier pocket 134 in an orientation generally parallel to the body of the wearer, preventing projectiles from moving through the ballistic protection into the body of the wearer, while eliminating compression on the breast tissue by displacing the proximal end of the ballistic plate 112 outwardly.

Figure 23:
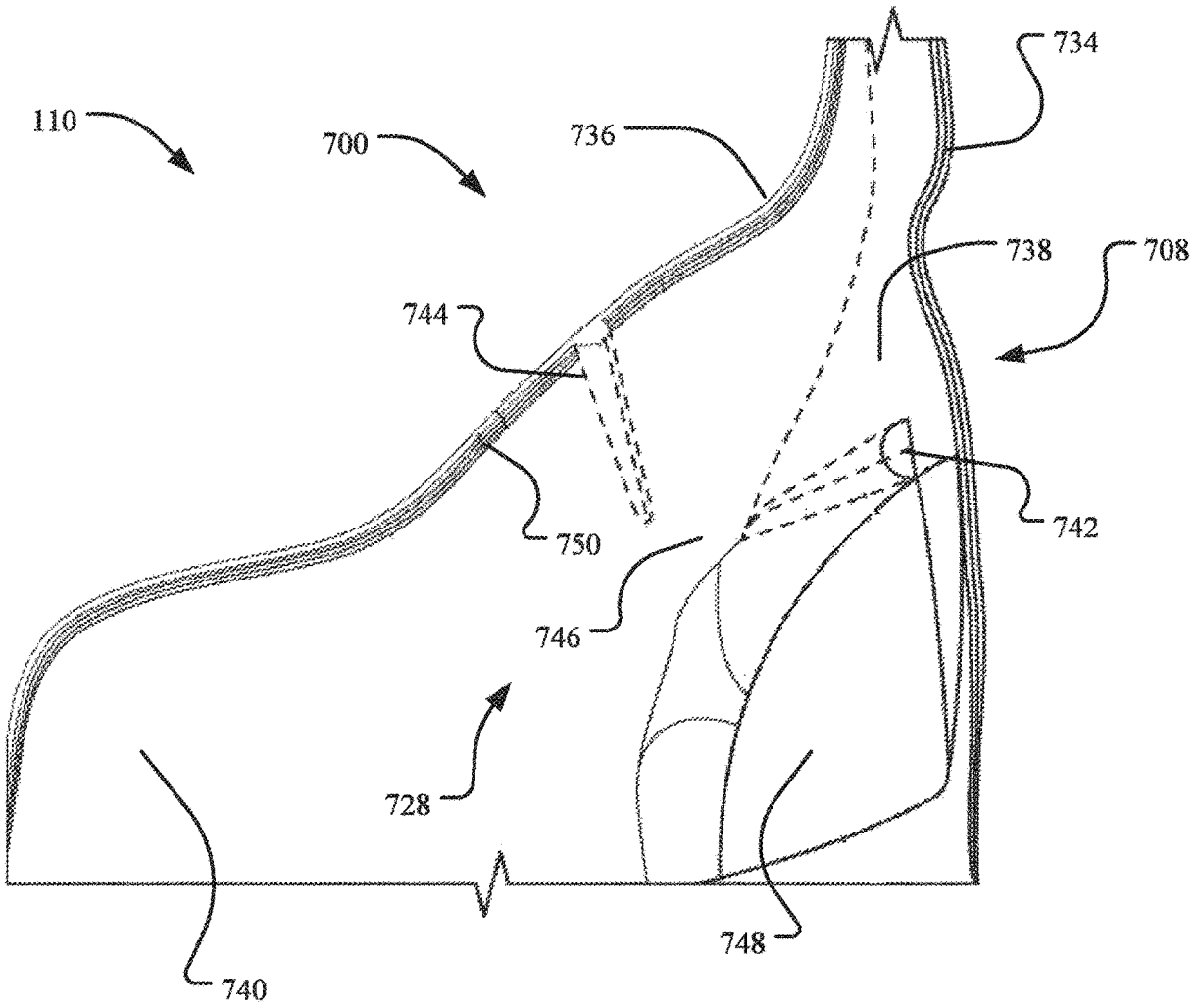
FIG. 23 shows a perspective cut-away view of the flexible body armor of FIG. 21.

Turning to FIG. 23, in one implementation, the one or more panels 708 includes a first panel 734 having one or more layers and a second panel 736 having one or more layers. The first panel 734 includes an inner surface 738 and the second panel 736 has an inner surface 740. In one implementation, the lateral darts are each formed from one or more raised pleats. For example, a first raised pleat 42 may be formed along the inner surface 738 of the first panel 734, and a second raised pleat 744 may be formed along the inner surface 740 of the second panel 736. The raised pleats 742 and 744 may each extend from a center area 746 of a respective cup portion 728 to a periphery 750. In one implementation, the raised pleats 742 and 744 form free space 748 of the cup portion 728 between the first panel 734 and the second panel 736. The raised pleats 742 and 744 may each be formed using a plurality of sewing lines extending from the center area 746 to the periphery 750. In one implementation, the lateral darts formed from the raised pleats 742 and 744 extend from the center area 746 to an edge of the lateral portion 704 of the flexible body armor 110 disposed between the upper valley 718 and the lower valley 722. After the raised pleats 742 and 744 are formed, the first panel 734 may be attached to the second panel 736, for example, using sewing, lamination (e.g., with an adhesive,) to form the flexible body armor 110.

Figure 24:
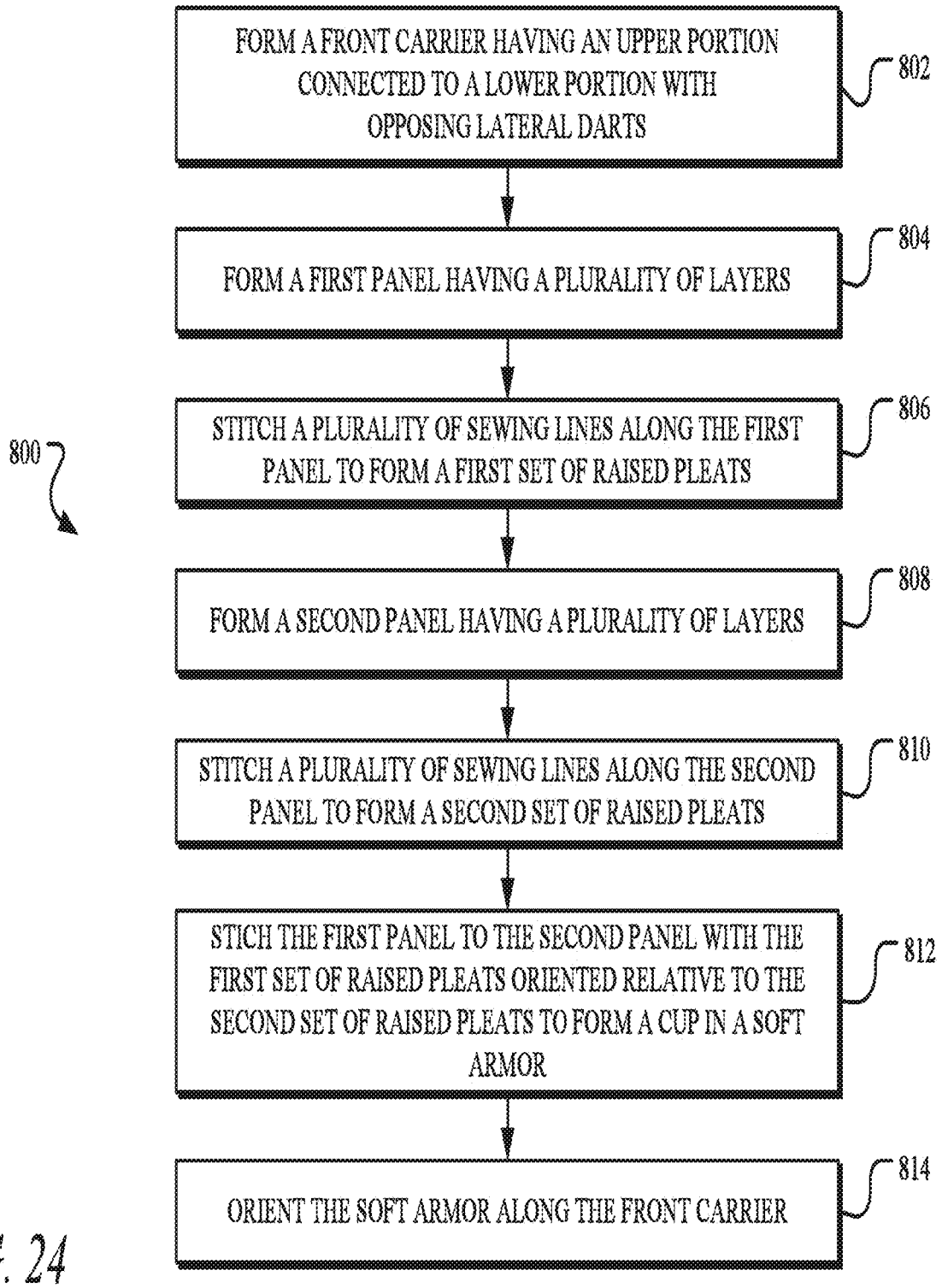
FIG. 24 illustrates example operations for manufacturing a tactical vest with a female shape.

FIG. 24 illustrates example operations 800 for manufacturing a female tactical vest. In one implementation, an operation 802 forms a front carrier having an upper portion connected to a lower portion with opposing lateral darts. An operation 804 forms a first panel from a plurality of layers of ballistic material. An operation 806 stitches a plurality of sewing lines along the first panel to form a first set of raised pleats, which may include one or more raised pleats. An operation 808 forms a second panel from a plurality of layers of ballistic material. An operation 810 stitches a plurality of sewing lines along the second panel to form a second set of raised pleats, which may include one or more raised pleats. An operation 812 stitches or otherwise attaches the first panel to the second panel with the first set of raised pleats oriented relative to the second set of raised pleats to form a cup in a soft ballistic armor. An operation 814 orients the soft ballistic armor along the front carrier, for example, in an interior of the front carrier.

Figure 25:
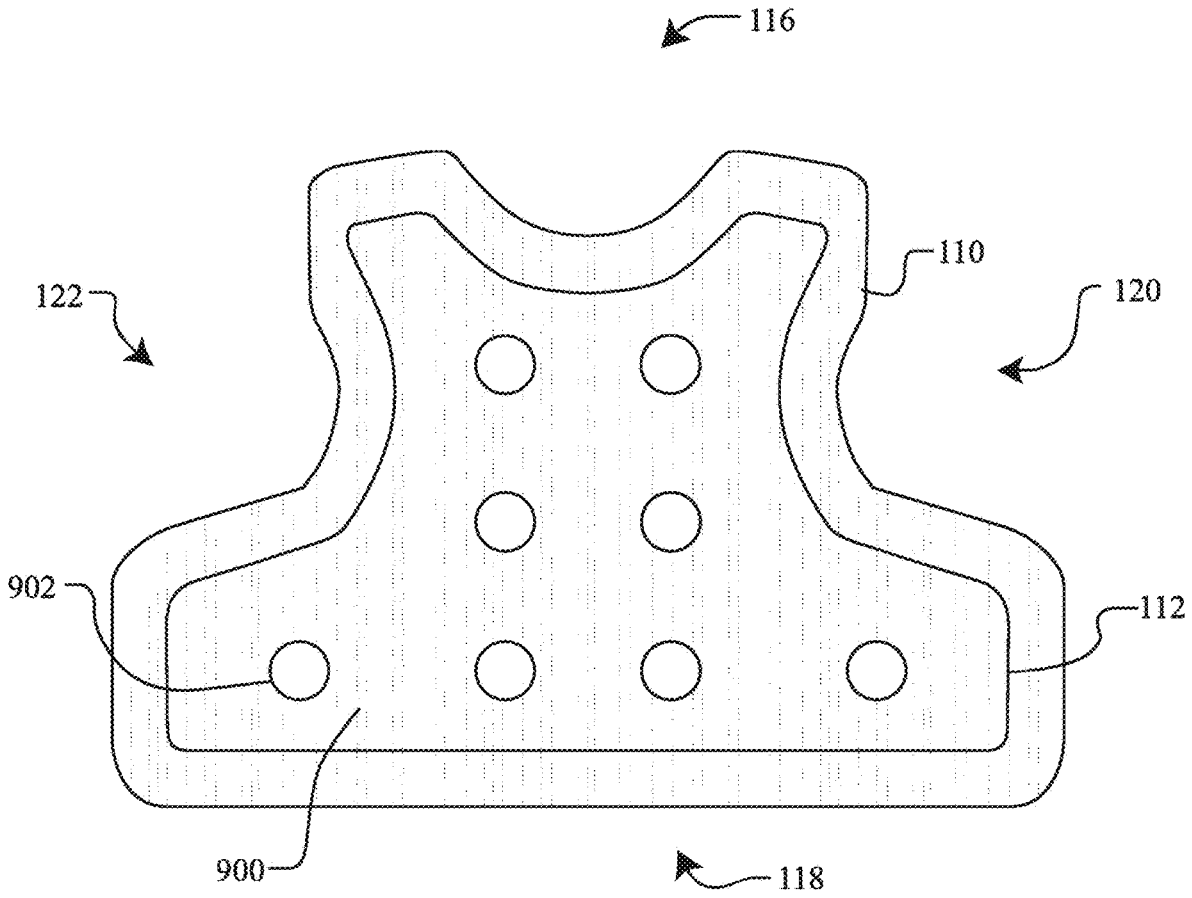
FIG. 25 illustrates an example frame disposed adjacent to the flexible body armor.

Turning to FIGS. 25-27, it will be appreciated that the ballistic frame 114 may be disposed behind or in front of and loose from the flexible body armor 110 within the interior 104. The ballistic frame 114 includes a frame body 900 configured to improve overall load carriage performance of the tactical system 100 by providing a rigid platform to add weight. The frame body 900 may be disposed loose or secured within the interior 104 to provide structural support to the outer layer 106, the inner layer 108, and/or other aspects of the tactical system 100. In one implementation, the frame body 900 is configured to support a load. The frame body 900 reduces fatigue by improving the structure of the tactical system 100 by retaining the flexible body armor 110 in a configuration that prevents bunching and provides support to the ballistic plate 112 to improve edge hit protection. The frame body 900 may be made from a polyethylene material, an ABS plastic material, an aramid fiber material, and/or other ballistics force dissipating material.

The ballistic frame 114 is unattached to the flexible body armor 110 within the interior 104, such as the front carrier pocket 134 where the tactical system 100 is a tactical vest. The ballistic frame 114 absorbs and otherwise dissipates energy from an impact of a projectile against the ballistic plate 112 and/or the flexible body armor 110. The ballistic frame 114 may be disposed in the interior 104 together with the flexible body armor 110 or without the flexible body armor 110.

In one implementation, the flexible body armor 110 is disposed within the interior 104 of the tactical system 100 and made from a force dissipating material. The ballistic frame 114 is disposed within the interior of the ballistic vest adjacent to and detached from the soft body armor component. The ballistic frame 114 may be disposed within the interior 104 between the outer layer 106 and the flexible body armor 110 or between the inner layer 108 and the flexible body armor 110. Stated differently, the ballistic frame 114 may be backed by the flexible body armor 110 or the flexible body armor 110 may be backed by the ballistic frame 114.

The ballistic frame 114 thus provides an additional protective layer to the flexible body armor 110 in some implementations, further dissipating the forces generated by the impact of a ballistic projectile and/or shrapnel against the flexible body armor 110. Another aspect of the ballistic frame 114 is a structural component that provides a framework to the tactical system 100 that is exterior to the flexible body armor 110 and provides structural integrity and prevents sagging of the outer layer 106 and other portions of the tactical system 100.

The frame body 900 may be solid or have one or more openings 902 therethrough. The openings 902 may have a variety of shapes including, but not limited to, circular, rectangular, elliptical, triangular, hexagonal, star, trapezoidal, angled, and/or contoured. The openings 902 may be symmetrical along at least one axis 906 of the frame body 900. For example, the openings 902 may include a first set of openings vertically aligned and a second set of openings vertically and/or horizontally aligned, with the first set of openings and the second set of openings being symmetrical.

The frame body 900 may have a variety of shapes, for example, asymmetrical, symmetrical, circular, square, rectangular, hexagonal, contoured, angled, and/or polygonal. The frame body 900 may be planar or extend along one or more angles or curves. Further, the frame body 900 may be sized and shaped based on a coverage area for protecting the wearer. The coverage area may include a deltoid area, a bicep area, a neck area, a yoke area, a collar area, and/or an extremity area.

In one implementation, the frame body 900 extends between a peripheral edge shaped based on ergonomics of the wearer and/or to mirror a shape of the flexible body armor 110 and/or the ballistic plate 112. For example, the frame body 900 may have a shape similar to the female shape 700. The peripheral edge may include a bottom edge 910 connected to a top edge 912 with a set of side edges 908. In one implementation, a width of the frame body 900 tapers proximally toward the top edge 912. Stated differently, the peripheral edge may include tapered edges 914 connecting the side edges 908 to the top edge 912. In another implementation, the side edges 908 extend proximally beyond the top edge 912 and peaks 916 curve to connect to the side edges 908 to the top edge 912.

Referring now to FIG. 28, in one implementation, the ballistic frame 114 may include one or more electrical systems coupled to the ballistic frame 114. For example, in FIG. 28, the ballistic frame includes each of a communications routing system 918 and a power supply system 920. The ballistic frame 114 may be incorporated into, among other things, a ballistic vest, a load carriage platform, and/or a backpack. The communications routing system 918 includes a plurality of wires connected to one or more communication connectors 922. Similarly, the power supply system 920 includes a plurality of wires connected to one or more power connectors 924. The communications routing system 918 and the power supply system 920 may be separate systems or integrated into one system, such that the wires and connectors 922 and 924 may be separate or the same. The communications routing system 918 and the power supply system 920 may be disposed around a periphery of the frame body 900, for example to avoid interference with the ballistic performance of the frame body 900 and/or decrease a risk of damage to the communications routing system 918 and/or the power supply system 920 caused by a ballistic impact or other threat.

Turning to FIG. 29, in one implementation, one or more pieces of equipment are connected to the communications routing system 918 and/or the power supply system 920 using a universal adapter 1000. The frame body 900 includes one or more connectors 1002, which may be the communication connector 922 and/or a power connector 924. Each of the connectors 1002 includes an opening 1004 extending through the frame body 900. The universal adapter 1000 includes a connection adapter for connecting a cable 1006 to the connector 1002. The cable 1006 may be any form of cable or wire configured to transmit data and/or power and may be encased with a cover, such as fabric or similar material.

The connection adapter may include a pin receiver 1008 configured to receive and engage a pin adapter 1010. The pin receiver 1008 may include an opening configured to receive a pin 1012 protruding from a base of the pin adapter 1010 and made from copper or another conductive material. The opening of the pin receiver 1008 puts the pin 1012 in contact with the cable 1006 for transmitting power and/or data. The pin receiver 1008 and/or the pin adapter 1010 may have a minimized profile. In one implementation, the pin adapter 1010 screws into the pin receiver 1008 via a bottom bolt.

As can be understood from FIGS. 30 and 31, the cable 1006 may extend from the pin receiver 1008 to an adapter port configured to engage equipment. In one implementation, the adapter port includes communications adapter port 1100 having a housing 1102 which may be made from an insulating material and facilitate connection of the communications adapter port 1100 to the equipment. A communications port head 1104 may extend from within the housing 1102 to connect to the equipment, such that data may be communicated between the equipment and a communications link or other computing device connected to the communications routing system 920 of the ballistic frame 900.

In another implementation, the adapter port includes power adapter port 1200 having a housing 1202 which may be made from an insulating material and facilitate connection of the power adapter port 1200 to the equipment. A power port head 1204 may extend from within the housing 1202 to connect to the equipment, such that power may be supplied to the equipment from a power source connected to the power supply system 1204 of the integrated ballistic frame 900. It will be appreciated that in some implementations, the adapter port is configured to supply power, as well as communicate data to and from the equipment.

In addition to or instead of individual ports, electrical systems in accordance with implementations of the present disclosure may include multi-port hubs that enable connection of multiple pieces of equipment at a given location. Such multi-port hubs may be used in electrical systems adapted for, among other things, communication, power management and data transfer. Such hubs may, in certain implementations, provide a one-to-many connection in which multiple ports are connected to a single wire or cable of the ballistic frame 114. As a result, the amount of cables required to supply power and/or communicate data between ports of the ballistic frame can be reduced.

In implementations in which the electrical system is adapted to provide communication functions, the electrical system may include or be coupleable to an antenna system. For example, in certain implementations an antenna coil may be coupled to the ballistic frame 114. In other implementations, the electrical system may include connectors and/or ports adapted to be connected to an antenna that extends from the ballistic vest, backpack, or other item in which the ballistic frame 114 is incorporated. The ballistic frame 114 may also include an integrated magnetic induction loop for wireless communication.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112 (f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A shield system, comprising:

a shield having a first corner, a second corner and a third corner;

an edge protection system comprising a first end, a second end, a first corner protector disposed on a first corner of the shield, a second corner protector disposed on the second corner of the shield and a third corner protector, and a third corner protector disposed on a third corner, wherein each of the first corner protector, second corner protector and third corner protector includes a first portion of the front face of the shield, a side of the shield, a second portion of the back face of the shield; and an edge coupling configured to engage the first end and the second end of the edge protection system and retain the edge protection system on the shield.

2. The shield system of claim 1, wherein the edge protection system is monolithic.

3. The shield system of claim 1, wherein the edge protection system is rubber.

4. The shield system of claim 1, wherein the plurality of corner protectors are molded into the edge protector.

5. The shield system of claim 1, wherein each of the first corner protector, second corner protector and third corner protector are connected to one another with an edge protection device that is disposed along the peripheral edge of the shield.

* * * * *